US011430292B2

(12) United States Patent
Thomas

(10) Patent No.: US 11,430,292 B2
(45) Date of Patent: Aug. 30, 2022

(54) BIOMETRIC-DATA-ACQUISITION-BASED ARRANGEMENTS BETWEEN ONLINE CONSULTANT AND ONLINE USER

(71) Applicant: Shneider Ramson Thomas, New City, NY (US)

(72) Inventor: Shneider Ramson Thomas, New City, NY (US)

( * ) Notice: Subject to any disclaimer, the term of this patent is extended or adjusted under 35 U.S.C. 154(b) by 0 days.

(21) Appl. No.: 17/335,058

(22) Filed: May 31, 2021

(65) Prior Publication Data

US 2021/0383639 A1 Dec. 9, 2021

Related U.S. Application Data

(60) Provisional application No. 63/034,672, filed on Jun. 4, 2020.

(51) Int. Cl.
*G07F 17/32* (2006.01)
*G06Q 50/34* (2012.01)

(52) U.S. Cl.
CPC ..... *G07F 17/323* (2013.01); *G06Q 50/34* (2013.01); *G07F 17/3206* (2013.01);
(Continued)

(58) Field of Classification Search
CPC ..... G07F 17/323; G07F 17/3206; G07F 17/3211; G07F 17/3239; G07F 17/329; G06Q 50/34
See application file for complete search history.

(56) References Cited

U.S. PATENT DOCUMENTS 7,175,528 B1 2/2007 Cumbers
7,565,263 B2 7/2009 Gianella
(Continued)

FOREIGN PATENT DOCUMENTS

WO WO 2017/066715 4/2017
WO WO 2019/086956 5/2019

OTHER PUBLICATIONS

CSGNetwork.com, Lottery_Number_Selectors, 1 page, Jun. 10, 2020, http://www.csgnetwork.com/lotterycalcs.html.
New York State Society of Certified Public Accountants, Pitkin, Doing the Right Thing: When is a Contingent Fee Arrangement Considered an Act Discreditable? 1 page, Jan. 1, 2015, https://www.nysscpa.org/news/publications/the-trusted-professional/article/doing-the-right-thing-when-is-a-contingent-fee-arrangement-considered-an-act-discreditable.
(Continued)

*Primary Examiner* — Werner G Garner
(74) *Attorney, Agent, or Firm* — Law Office Of David J. Rosenblum; David J. Rosenblum

(57) ABSTRACT

A lottery pick advising system includes a user-operable computing device having a screen, camera, processor, and memory comprising code of an application computer program, the code configured to: (a) as part of an identity authentication session of the program, operate the computing device to, during the authentication session, capture, for identity authentication: an image of a fingerprint of the user, an image of the user's face with the camera such that the user's face is facing the screen, or both types of images; (b) offer, onscreen, the user a full-price upfront option of paying in full upfront in exchange for receiving from a lottery pick advising service a suggestion as to, from among a set of lottery numbers possibly drawable in a particular upcoming lottery drawing, what one or more subsets of the lottery numbers to play as respective one or more picks in the drawing and (c) offer as an onscreen alternative a contingency fee arrangement of at a reduced price upfront and/or free-of-charge upfront receiving the suggestion for which compensation is owed if he wins. The captured images may aid in tracking and/or identifying the user to assure fulfillment of the contingency fee arrangement.

28 Claims, 9 Drawing Sheets

(52) U.S. Cl.
CPC ..... *G07F 17/329* (2013.01); *G07F 17/3211* (2013.01); *G07F 17/3239* (2013.01)

(56) References Cited

U.S. PATENT DOCUMENTS

| | | | |
|---|---|---|---|
| 7,779,457 | B2 | 8/2010 | Taylor |
| 8,512,134 | B2 | 8/2013 | Hardy et al. |
| 8,972,299 | B2 | 3/2015 | Kelley |
| 10,032,048 | B1 | 7/2018 | Barton et al. |
| 10,325,447 | B2 | 6/2019 | Malek |
| 10,776,471 | B2 | 9/2020 | Tussy |
| 10,803,160 | B2 | 10/2020 | Tussy |
| 2008/0220856 | A1 | 9/2008 | Lynch et al. |
| 2009/0061977 | A1 | 3/2009 | Brandt et al. |
| 2010/0106534 | A1 | 4/2010 | Robinson et al. |
| 2012/0276976 | A1 | 11/2012 | Yoo et al. |
| 2013/0159194 | A1 | 6/2013 | Habib |
| 2013/0231987 | A1 | 9/2013 | Veverka et al. |
| 2013/0310133 | A1 | 11/2013 | Walker et al. |
| 2015/0105132 | A1 | 4/2015 | Gross |
| 2015/0339703 | A1 | 11/2015 | Karlin et al. |
| 2019/0156615 | A1 | 1/2019 | Acres |
| 2019/0147704 | A1 | 5/2019 | Scott et al. |
| 2019/0206012 | A1 | 7/2019 | Granich et al. |
| 2019/0272545 | A1 | 9/2019 | Ozvat et al. |
| 2019/0303551 | A1 | 10/2019 | Tussy |
| 2019/0370892 | A1 | 12/2019 | Rampell et al. |
| 2020/0184778 | A1 | 6/2020 | Scott et al. |
| 2020/0394290 | A1 | 12/2020 | Tussy |

OTHER PUBLICATIONS

Accounting Tools, Contingent Fee Definition, 1 page, Apr. 12, 2021, https://www.accountingtools.com/articles/2019/2/17/contingent-fee.

Wired, Ears Could Make Better Unique IDs Than Fingerprints, 1 page, Nov. 12, 2010, https://www.wired.com/2010/11/ears-biometric-identification/.

Liveness.com, Biometric Liveness Detection Explained, 1 page, Nov. 21, 2020, https://www.liveness.com/.

Comcast, What Is Facial Recognition on a Phone?, 1 page, Jan. 21, 2019, https://www.xfinity.com/hub/mobile/facial-recognition-on-phone.

SoftPedia, Lotto Pyramid, 1 page, Jul. 20, 2020, https://www.softpedia.com/get/Others/Finances-Business/Lotto-Pyramid.shtml.

Lottery Wonder-Grid Revisited—New Lottery Pairing Research, Software, 1 page, Jul. 20, 2020, https://saliu.com/bbs/messages/grid.html.

Lotto Exposed, Pyramid System—A Complex Lottery Strategy, 1 page, Jul. 20, 2020, https://www.lottoexposed.com/pyramid-system/.

Whay Law Firm, Restriction on Fees to Consultants, 1 page, Oct. 12, 2015, https://www.whaylaw.com/restrictions-on-fees-to-consultants.

Amazon.com Inc., Ilya Bluskov, 1 page, Jun. 13, 2020, https://www.amazon.com/Iliya-Bluskov/e/B004E8BRD8%3Fref=dbs_a_mng_rwt_scns_share.

Forbes, Wood, Contingent Fee Tax Advice: IRS Allows Some, Not All, 1 page, May 10, 2017, https://www.forbes.com/sites/robertwood/2017/05/10/contingent-fee-tax-advice-irs-allows-some-not-all/?sh=2e88a28739d7.

Commando Consulting, Varjan, How to Estimate and Price Contingency Fee Based Consulting Engagements, 1 page, Nov. 2012, http://www.di-squad.com/toolshed/e-zine-2012-11-how-to-estimate-and-price-contingency-based-consulting-engagements.

Brian, The Winning Lottery Number Generator, 1 page, Jun. 10, 2020, https://www.lottery-winning.com/lottery-number-generator/.

Wikipedia, Lottery Wheeling, 1 page, Jun. 16, 2020, https://en.wikipedia.org/wiki/Lottery_wheeling.

Expert Lotto, Statistical Filter, 1 page, Jul. 7, 2020, http://www.expertlotto.com/en/help/en/filters/stats_filter.html.

Bluskov, Combinatorial Systems (Wheels) with Guaranteed Wins for PICK-5 Lotteries including Euro Millions and the Mega Lotteries, 1 page, Jun. 21, 2020, http://www3.telus.net/lotbook/pick5book.html.

Accounting Tools, Contingent Fee Definition, 1 page, [retrieved on Apr. 12, 2021]. Retrieved from the Internet <URL: https://www.accountingtools.com/articles/2019/2/17/contingent-fee>.

Wired, Ears Could Make Better Unique IDs Than Fingerprints, 1 page, Nov. 12, 2010, [retrieved on Nov. 21, 2020]. Retrieved from the Internet <URL:https://www.wired.com/2010/11/ears-biometric-identification/>.

Liveness.com, Biometric Liveness Detection Explained, 1 page, [retrieved on Nov. 21, 2020]. Retrieved from the Internet <URL: https://www.liveness.com/>.

Comcast, What Is Facial Recognition on a Phone?, 1 page, Jan. 21, 2019, [retrieved on Dec. 26, 2020]. Retrieved from the Internet <URL: https://www.xfinity.com/hub/mobile/facial-recognition-on-phone>.

SoftPedia, Lotto Pyramid, 1 page, [retrieved on Jul. 20, 2020]. Retrieved from the Internet <URL: https://www.softpedia.com/get/Others/Finances-Business/Lotto-Pyramid.shtml>.

Lottery Wonder-Grid Revisited—New Lottery Pairing Research, Software, 1 page, retrieved on Jul. 20, 2020]. Retrieved from the Internet <URL: https://saliu.com/bbs/messages/grid.html>.

Lotto Exposed, Pyramid System—A Complex Lottery Strategy, 1 page, [retrieved on Jul. 20, 2020]. Retrieved from the Internet <URL: https://www.lottoexposed.com/pyramid-system/>.

Whay Law Firm, Restriction on Fees to Consultants, 1 page, Oct. 12, 2015, [retrieved on Jun. 15, 2020]. Retrieved from the Internet <URL: https://www.whaylaw.com/restrictions-on-fees-to-consultants>.

Amazon.com Inc., Ilya Bluskov, 1 page, [retrieved on Jun. 13, 2020]. Retrieved from the Internet <URL https://www.amazon.com/Iliya-Bluskov/e/B004E8BRD8%3Fref=dbs_a_mng_rwt_scns_share>.

Forbes, Wood, Contingent Fee Tax Advice: IRS Allows Some, Not All, 1 page, May 10, 2017, [retrieved on Jun. 11, 2020]. Retrieved from the Internet <https://www.forbes.com/sites/robertwood/2017/05/10/contingent-fee-tax-advice-irs-allows-some-not-all/?sh=2e88a28739d7>.

Commando Consulting, Varjan, How to Estimate and Price Contingency Fee Based Consulting Engagements, 1 page, Nov. 2012, [retrieved on Jun. 24, 2020]. Retrieved from the Internet <URL: http://www.di-squad.com/toolshed/e-zine-2012-11-how-to-estimate-and-price-contingency-based-consulting-engagements>.

Brian, The Winning Lottery Number Generator, 1 page, [retrieved on Jun. 10, 2020]. Retrieved from the Internet <https://www.lottery-winning.com/lottery-number-generator/>.

Wikipedia, Lottery Wheeling, 1 page, [retrieved on Jun. 16, 2020]. Retrieved from the Internet <URL: https://en.wikipedia.org/wiki/Lottery_wheeling>.

Expert Lotto, Statistical Filter, 1 page, [retrieved on Jul. 7, 2020]. Retrieved from the Internet <URL:http://www.expertlotto.com/en/help/en/filters/stats_filter.html>.

Bluskov, Combinatorial Systems (Wheels) with Guaranteed Wins for PICK-5 Lotteries including Euro Millions and the Mega Lotteries, 1 page, [retrieved on Jun. 21, 2020]. Retrieved from the Internet <URL: http://www3.telus.net/lotbook/pick5book.html>.

CSGNetwork.com, Lottery_Number_Selectors, 1 page, [retrieved on Jun. 10, 2020]. Retrieved from the Internet <http://www.csgnetwork.com/lotterycalcs.html>.

FaceTec Digital Certificate, 1 page, [retrieved on Aug. 10, 2020]. Retrieved from the Internet <URL: IDcheck.FaceTec.com>.

About FaceTec, 1 page, [retrieved on Aug. 10, 2020]. Retrieved from the Internet <URL: www.facetec.com>.

Gmail—Your FaceTec EZ ID is Here!, 1 page, Aug. 10, 2020, [retrieved on Aug. 10, 2020]. Retrieved from the Internet <URL: IDcheck.FaceTec.com>.

Enhancing Trust with AI-Driven Biometrics, 19 pages, Aug. 2020, [retrieved on Aug. 14, 2020]. Retrieved from the Internet <https://www.fintechfutures.com/2020/08/white-paper-enhancing-trust-with-ai-driven-biometrics/>.

(56) References Cited

OTHER PUBLICATIONS

Findbiometrics, Trusted Identity, 12 pages, Oct. 2019, [retrieved on Aug. 14, 2020]. Retrieved from the Internet <https://www.zoomlogin.com/White_Paper_Anchoring_Identity_Oct_2019.pdf>.

CIOReview, FaceTec: Replacing Passwords with 3D Face Authentication, 1 page, [retrieved on Nov. 21, 2020]. Retrieved from the Internet <URL: https://security.cioreview.com/vendor/2018/facetec>.

New York State Society of Certified Public Accountants, Pitkin, Doing the Right Thing: When is a Contingent Fee Arrangement Considered an Act Discreditable? 1 page, Jan. 1, 2015, [retrieved Dec. 1, 2020]. Retrieved from the Internet <URL: https://www nysscpa.org/news/publications/the-trusted-professional/article/doing-the-right-thing-when-is-a-contingent-fee-arrangement-considered-an-act-discreditable>.

SmartLuck, Free Interactive Lotto Wheel 52225, 1 page, [retrieved on Jun. 15, 2020] Retrieved from the Internet <URL: https://www.smartluck.com/free-lotto-wheel-52225js.htm>.

Dzienkowski, The Decline in Tax Adviser Professionalism in American Society, Fordham Law Review, Jul. 23, 2016, [retrieved on Jun. 11, 2020]. Retrieved from the Internet <URL: https://ir.lawnet.fordham.edu/flr/vol84/iss6/14>, pp. 2731, 2737, 2742, vol. 84, Issue 6, Article 14.

SmartLuck, The All-Important Balanced Game, 1 page, [retrieved on Jun. 16, 2020]. Retrieved from the Internet <URL https://www.smartluck.com/gail-howard-balanced-game.htm>.

CSGNetwork.com, Number_Selector_NY_Lotto, 1 page, [retrieved on Jun. 10, 2020]. Retrieved from the Internet <URL: http://www.csgnetwork.com/nylottommcalc.html>.

Factec 2-second Selfie, 1 page, [retrieved on Feb. 6, 2021]. Retrieved from the Internet <URL: www.facetec.com>.

BIOMETRIC-DATA-ACQUISITION-BASED ARRANGEMENTS BETWEEN ONLINE CONSULTANT AND ONLINE USER

CROSS-REFERENCE TO RELATED APPLICATION

This application claims the benefit of U.S. Provisional Patent Application No. 63/034,672 filed Jun. 4, 2020.

FIELD OF THE INVENTION

The present invention relates to online consulting and, more particularly, to arrangements by which online users are afforded online consulting services.

BACKGROUND

Lawyers who potentially will, and expect to, prevail in court often offer the client a contingency fee (or "contingent fee") agreement. These arrangements provide that the lawyer will not charge a fee for his services. In exchange, the law firm, if it wins in court, directly receives the court judgment, divides out its share, e.g., one third, and forwards the remainder to the client. The lawyer's services on behalf of the client are specific to that client. Because the lawyer is forgoing compensation for services unless he wins a judgment, he is usually willing to take on a case only if the prospects for winning the case look good.

A business consultant may also enter into a contingency fee arrangement. Typically, however, he would not receive the business' revenues directly but, instead, would receive his compensation from the company. There exists an expectation that the consultant will produce results; otherwise, generally-speaking the business would not have turned over its fate to the consultant's judgement/decision-making.

Although accountants are by law most often not allowed to charge contingency fees, in a few contexts the fees are permitted. The accountant, like the above-mentioned service providers, is providing free services that are specific to the client or the client's particular situation. She likewise is not likely to enter into the arrangement unless she expects to secure for the client enough money that her share substantially exceeds the cost she would otherwise charge for her services.

The contingency fee arrangement, when available, is typically chosen by clients who cannot afford to or are reluctant to either pay or obligate themselves to pay for a service the outcome of which is initially uncertain. Rather than miss a needed or potentially profitable opportunity, a client can take advantage of the contingency fee arrangement.

A known, simple example of lottery pick advice is to avoid the numbers up to 31, because your competition will pick them as lucky months and days if the available numbers run, for example, from 1 to 70. By skipping over (i.e., filtering out) these lower numbers, you cut down on the number of competitors with whom you potentially have to share your prize. This raises the expected value of your lottery ticket. For the same reason, you might also want to avoid a string of consecutive numbers, because experience has shown that many players will include a string of consecutive numbers in their pick. U.S. Pat. No. 7,565,263 to Gianella discloses a tool available to customers for their use on a subscription basis for making behavior-pattern-based lottery picks. Another known way of picking the numbers to play is through the use of lottery wheeling, which is popular with lottery syndicates, also called "lottery groups" or "lottery clubs." It involves purchasing, for an upcoming lottery drawing, a relatively small number of lottery tickets that collectively guarantee at least a predetermined minimum tier of winning if, from among your set of lucky numbers, a subset of at least a given size is drawn for that lottery drawing. The syndicate may have, in accordance with the contract governing it, a manager who picks the tickets to purchase, purchases them, collects the lottery prizes won, and distributes out profit from the winnings, that profit being shared by the participants/subscribers who pay to maintain their enrollment in the syndicate.

SUMMARY

Due to the trust a business places in the above-mentioned business consultant and what is at stake, a business consultant is in a position to negotiate. She may insist that she be able to closely monitor the enterprise and contractually assure at the outset that she will receive the contingency fee due. For example, a credit check may be required. The consultant may ask the client for proof that back taxes have been paid. If a consultant is developing a productive or profitable online system for the client, he may keep all the passwords to himself to guarantee payment.

The contingency fee clients of an accountant, although generally looking to avoid upfront costs, typically have the tangible prospect or expectation of winning a sizeable judgment or tax refund. The accountant is therefore, as in the case of the business consultant, in a position of leverage to ensure, beforehand, payment of a contingency fee in the event the accountant delivers on the anticipated outcome. A tax refund, for example, may be received from the Internal Revenue Service as a deposit into the accountant's business account by mutual agreement between the accountant and the client.

The law firm in a contingency fee case receives the winning judgment directly and can take out the contingency fee directly. Thus, payment of the contingency fee based on a favorable outcome is guaranteed to the law firm. A lawyer will not take a contingency fee case unless he expects to win it.

Although lawyers, accountants, and business consultants generally offer their clients expected outcomes, a lottery pick advising service could not offer the same likelihood that the suggested lottery pick(s) will win big. That is, although the suggested picks may increase the odds of winning big, the odds are still relatively low. Because of this and because the lottery is a game an individual could easily decide not to play, it is not practical to require the customer to go through an extensive intake process, a credit check, or delving into the customer's finances. Yet, it is, according to what is being proposed herein below, the client (i.e., lottery player or "user" of the lottery pick advising program which may be an app) who directly receives the lottery prize. Many potential customers like the idea of collecting their winnings directly. They also would like the idea of paying less up front or avoiding any cost at all unless it comes out of their winnings.

If the client wins the lottery, or is among the lottery winners, but does not cooperate in meeting the contingency fee obligation, it is the burden of the instant, innovative, contingency-fee-offering lottery pick advising service (which may include one or more lottery pick advisors) to identify and/or track the client in order to collect and/or recover the service's contractual share of the prize (i.e., to collect/recover the contingency fee).

In this context, it should be noted that a jackpot winner has much more of an opportunity to take the money and disappear than does the contingency fee client of the lawyer, accountant, or business consultant.

The lottery pick advising service's tracking burden, i.e., the burden of tracking and/or identifying the debtor, represents more than a nominal or insignificant relationship to known contingency fee relationships. That is, as indicated herein above, known contingency fee relationships do not require from the service provider anywhere near as much of a tracking burden. An exemplary identity authentication session described herein below provides authentication data, such as a facial image, used for safely accepting payment online. Identity authentication relates to determining whether a person is who they say they are. However, the identity authentication session goes further in acquiring information utilizable, as by a private investigator, in meeting this increased tracking burden the lottery pick advising service assumes from the outset. The acquiring is done efficiently due in part to recent advances in identity checking online. This tracking burden of the service involves collecting and/or recovering the service's contractual contingency fee under the contingency fee arrangement from lottery-winning clients who disappear without paying. Clients disappearing without paying is not unlikely. On the one hand, it would be unusual for a wealthy individual to go entirely off the grid, because of the degree of sacrifice it would require in terms of the daily comforts rich, and even middle-class, people could otherwise enjoy. It is, however, not necessary to go entirely off the grid—a suddenly wealthy person could use his new-found resources to disappear to an extent that it would not be easy to locate the person or his assets. He or she could, for instance, pull up all roots and move to a secluded beachfront location somewhere in the world. In fact, with the suddenly obtained wealth, the jackpot winner may want to distance himself from current friends and from family if he feels he would be prevailed upon beyond his comfort zone.

Outlays for recovering what you are owed from a fleeing debtor are worth making for the contingency fee portion of a lottery jackpot or other sizeable prize. Thus, the application of a contingency fee in the instant innovative context is, despite the uniquely high tracking burden, a practical course of action.

Notably, in the context of horse racing, a Pick 6 winner could be an instant millionaire on a flight out of the country later that day which would likely complicate or make practically impossible knowing where in the world he or she went; whereas a lottery jackpot winner faces weeks or months of delay before collecting. This allows for monitoring the whereabouts of the lottery winner who, as a condition of the contingency arrangement, consents to such monitoring during the monitoring time-period between winning the lottery and paying the contingency fee. The uniqueness of the lottery situation, and the recent advances in identity checking online, together facilitate tracking with a tracking burden that is greater than that faced by other consultants and yet feasible in view of the jackpot portion one reasonably can expect to recover as a result of the tracking. The tracking burden and processes for recovery are discussed further below. What the inventor proposes herein thus integrates the contingency fee model into a practical application in the lottery pick advisement context.

In an exemplary aspect, a lottery pick advising system includes a user-operable computing device having a screen, camera, processor, and memory comprising code, of an application computer program, configured to, as part of an identity authentication session of the program, operate the computing device to, during the authentication session, capture, for identity authentication: an image of a fingerprint of the user, an image of the user's face with the camera such that the user's face is facing the screen, or both types of images. The code is further configured to offer, onscreen, the user a full-price upfront option of paying in full upfront in exchange for receiving from a lottery pick advising service a suggestion as to, from among a set of lottery numbers possibly drawable in a particular upcoming lottery drawing, what one or more subsets of the lottery numbers to play as respective one or more picks in the drawing. The code is yet further configured to offer as an onscreen alternative an option of at a reduced price upfront and/or free-of-charge upfront receiving by the user a suggestion from the lottery pick advising service as to, from among the set of lottery numbers possibly drawable in the particular upcoming lottery drawing, what one or more subsets of the lottery numbers to play as respective one or more picks in the particular upcoming lottery drawing. The alternative option involves a contingency fee arrangement such that the user is, by accepting the alternative option, conditionally committing, dependent on an outcome of the particular upcoming lottery drawing, to provide the lottery pick advising service compensation for the suggestion.

In another aspect, the captured images may aid in tracking and/or identifying the user to assure fulfillment of the contingency fee arrangement.

In a further aspect, the system further includes a database, remotely located from the computing device, which is utilized for receiving the image of the user's face, the image of the user's fingerprint, or both types of images, for potential use in tracking, identifying, or both tracking and identifying the user to recover the contingency fee.

Details of the innovative biometric-data-acquisition-based arrangements between online lottery pick consultant and online user are set forth further below, with the aid of drawings, which are not drawn to scale.

DETAILED DESCRIPTION

Figure 1A:
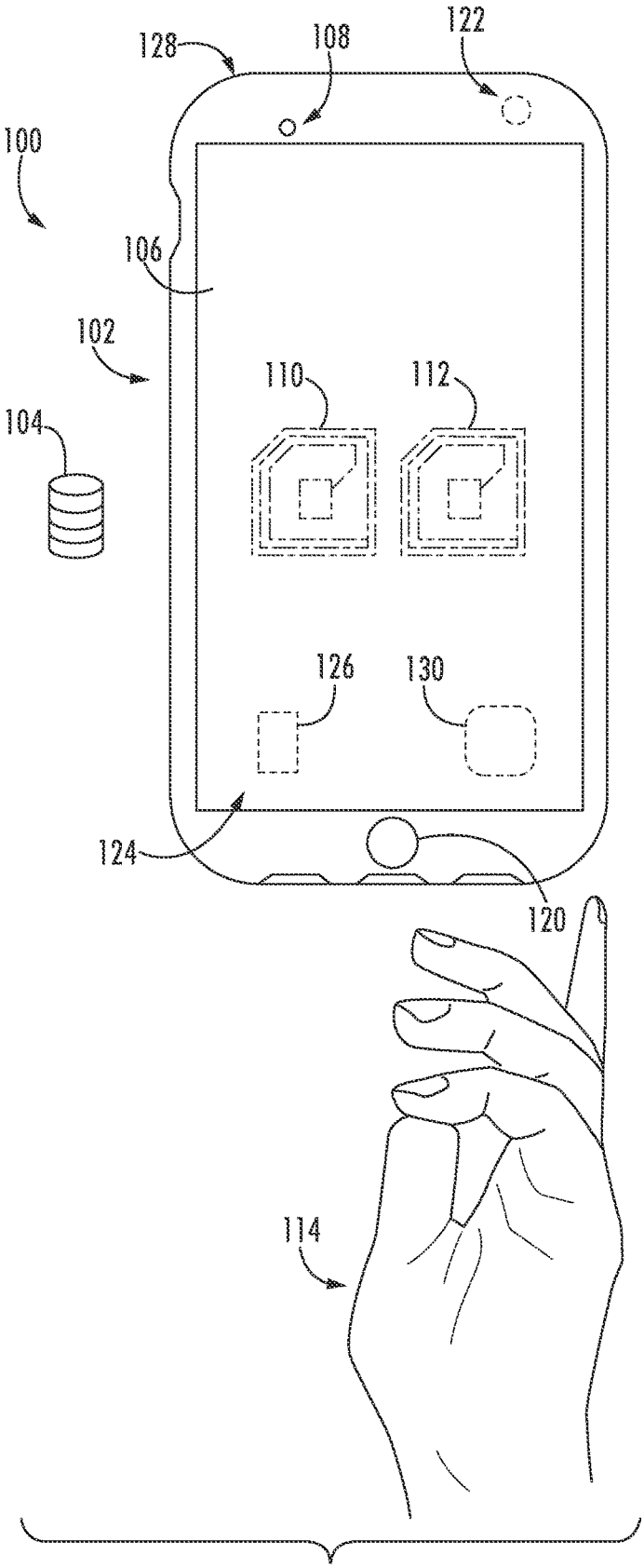
FIG. 1A is a schematic view of a lottery pick advising system and a user in accordance with what is proposed herein.
Figure 1B:
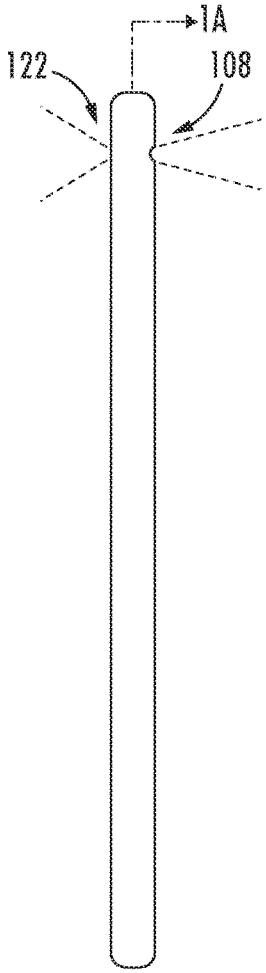
FIG. 1B is side view of a computing device in the system of FIG. 1A.
Figure 1C:
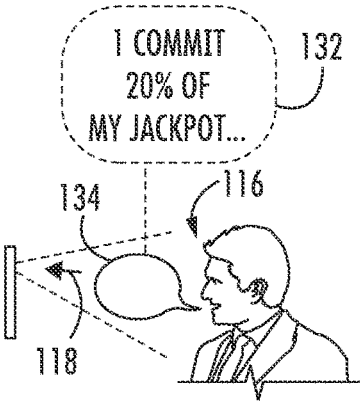
FIG. 1C is an illustrative view of a user recording a conditional commitment in accordance with what is proposed herein.

With reference to FIG. 1, a system 100 for lottery pick advising includes, by way of illustrative and non-limitative example, a computing device 102 implemented in a cell phone sold under a trademark such as IPHONE, or a cell phone running under an operating system sold under the trademark ANDROID or WINDOWS MOBILE OPERATING SYSTEM for example. The system further includes a remotely-located Authentication and Collections (A&C) Database 104. The computing device 102 includes a screen 106, a front-facing camera 108, a processor 110, and a memory 112. The memory 112 includes a non-transitory computer-readable medium embodying stored processor-executable code for authenticating a user 114 when he/she uses an application computer program 302, e.g., a phone app, shown in FIG. 3, to get suggested picks for a particular upcoming lottery drawing 501 which is represented in FIG. 2. The processor-executable code is capable of being executed by the processor 110 of the computing device 102. The computing device 102 can, however, be standalone or Internet-enabled. It can be portable or stationary, for example a mobile consumer-electronic telecommunication apparatus, a tower-style personal computer, or a laptop.

Any reference herein to processor-executable code of an application computer program 302 refers to that code as embodied (i.e., stored) in the computer-readable medium.

The application computer program 302 is distinct from system software an example of which is the system software that comes with a phone to authenticate the user 114 signing in. Such system software is employed in TOUCH ID which is marketed under the trademark APPLE for instance. The application computer program 302 (or "lottery pick advising program") may be designed for a personal computer. Or it may be somewhat reduced in functionality to serve as an "app" for a mobile device, like a phone, and thus may be downloadable from an online store and immediately installed for operation. The lottery pick advising program will be discussed in the examples below in the context of an app and will at times be referred to herein after as an "app."

Users 114 are given a choice on whether to pay in full upfront for advice on lottery picks, or whether to pay on a contingency-fee basis in accordance with a contingency fee arrangement.

An identity authentication session for authenticating the user 114 is required when the user 114 is, totally or in part, not paying upfront for the lottery pick advice or is not using a verified payment account, such as one marketed under the brand PAYPAL. Because a given identity authentication session may not result in authenticity being established, if what has been requested from the user 114 is not deemed to be complete upon receipt for instance, more than a single identity authentication session could be needed to receive one or more suggested picks. In addition, an identity authentication session may be needed each time a user 114 wants to receive one or more suggested lottery picks. The exemplary identity authentication sessions presented herein below may, for upfront paying customers not using a verified payment account, be shortened to less vigorous versions.

The processor-executable code can be configured to, as part of an identity authentication session 301 of the application computer program 302, operate the computing device 102 to capture one or more images during the identity authentication session 301.

One type of image is of the user's face 116 with the camera 108 such that the user's face 116 is facing 118 the screen 106 so that a front view of the face 116 is obtained. Another type of image is of a fingerprint 202 of the user 114. Fingerprint scanning techniques include optical, capacitive, ultrasonic, and thermal scanning. A phone's camera, for example a rear-facing camera, can be used for optical scanning of a fingerprint. Identity authentication is possible by comparing the scanned fingerprint to a stored copy of the fingerprint 202. Typically, however, a phone's fingerprint scanner 120 with a sensor dedicated for scanning the user's finger to acquire the fingerprint 202 is what is used to capture a user's fingerprint for authentication of the user's identity based on the fingerprint 202. Smartphones typically have a fingerprint scanner or facial recognition. They are further outfitted with motion detecting sensors such as an accelerometer, a magnetometer, and a gyroscope that cooperate in location and orientation determination. Motion detecting sensors can be used in facial-image-based liveness detection which is discussed further herein below.

The processor-executable code can be configured to, as part of an identity authentication session 301 of the application computer program 302, operate the computing device 102 to capture, for identity authentication, an image of a fingerprint 202 of the user 114, an image 242 of the user's face 116 with the camera 108 such that the user's face 116 is facing 118 the screen 106 (i.e., one or the other type of image), or both types of images. The capturing also facilitates, if the user 114 wins 203*a* (rather than loses 203*b*) in the upcoming lottery drawing 501 but fails to timely pay a contingency fee 204, tracking and/or identifying the user 114 to assure fulfillment of the contingency fee arrangement 205.

The operating to capture the image of the fingerprint 202, if the capturing of such is configured, might be made possible by virtue of the fact that computing device 102 does in fact include the front-facing camera 108. This would be the case if, for example, it is the front-facing camera 108 that is being used to capture the fingerprint 202. Or the capturing of the image of the fingerprint 202, if the capturing of such is configured, is or would be made possible by virtue of the computing device 102 including other devices. Among these other devices is another (e.g., rear-facing) camera 122 and a fingerprint scanner 120. Thus, the processor-executable code of a given embodiment might be designed to use the fingerprint scanner 120 to capture the fingerprint 202. Or it might be designed to use the front-facing camera 108 for that function. Or it might be designed to use the second-mentioned, i.e., "another", camera 122 for that function. Or, as a further alternative, it might be designed to use, for that function, both the fingerprint scanner 120 and the front-facing camera 108 (e.g., either one according to the user's choice at the time when a fingerprint is to be captured), both the fingerprint scanner 120 and the "another" camera 122, both the front-facing camera 108 and the "another" camera 122, or all three of the fingerprint scanner 120, the front-facing camera 108, and the "another" camera 122. Thus, the operating to capture the image 240 of the fingerprint 202, if the capturing of such is configured in the processor-executable code, operates any one or more of the front-facing camera 108, another camera 122, and a fingerprint scanner 120.

The processor-executable code may be, and in this example is, configured to capture, for identity authentication, both types of images, by means of the computing device 102 during the identity authentication session 301 of the application computer program 302.

In particular, the computing device 102 of this example operates the processor 110 which executes the processor-executable code of the application computer program 302. The application computer program 302 may, responsive to the code, direct the processor 110 to issue commands to cause the camera 108, 122 and the fingerprint scanner 120 to function, in accordance with how the processor-executable code embodied in the computer-readable medium is configured, to respectively capture the image 242 of the user's face 116 and the image 240 of the user's fingerprint 202.

System software may handle scanning a fingerprint 202 to log in to the computing device 102. Such signing on to a device may precede, but does not occur during, the identity authentication session 301 of the application computer program 302. It does not occur as part of the identity authentication session 301 of the application computer program 302, i.e., "lottery pick advising program." Likewise, scanning your fingerprint to sign into an app does not occur during and as part of the identity authentication session 301. Compare steps S804 and S822 in FIG. 8.

The computing device further may include an audio recording device 124 that includes a microphone 126, and a video recording device 128 that includes the front-facing camera 108. Any such devices which are part of the computing device 102 are likewise operable in accordance with the processor-executable code.

The contingency fee arrangement 205 may provide that the user 114 will, if the user 114 wins 203*a* in the particular upcoming lottery drawing 501 for which the lottery pick suggestion(s) was received, provide, in return, compensation to a lottery pick advising service that has provided the pick suggestion(s).

The lottery pick advising program (herein after "app") may be, by virtue of the processor-executable code, further configured to ask the user 114 to recite a conditional commitment 203. In particular, the user 114 is asked to, in exchange for the user 114 receiving the suggestion(s) from a lottery pick advising service 312, verbally recite 132 a conditional commitment 203 to compensate the lottery pick advising service 312 on a contingency fee basis in accordance with the contingency fee arrangement 205, i.e., in the form of a written contract. The verbal recitation 132 may be recorded, as discussed further herein below.

The asking may occur via the screen 106, an audio speaker 130, or both the screen 106 and the audio speaker 130. The last two possibilities only apply operationally, i.e., for actually asking the user 114, if the computing device 102 includes (as is typical) an audio speaker 130. More generally, the app can do the asking by any known and suitable communication method.

The A&C Database 104 will generally be remotely located 306 from the computing device 102 of any given user 114. The database 104 can receive (by relay 303*a*, 303*b* for example from the lottery pick advising service 312), for potential use in tracking and/or identifying a lottery-winning user 114 who is not complying with the contingency fee arrangement 205, the above-described captured images of the user's face 116, the user's fingerprint 202, or both types of images 242, 240. These processes are discussed further below in more detail.

Figure 2A:
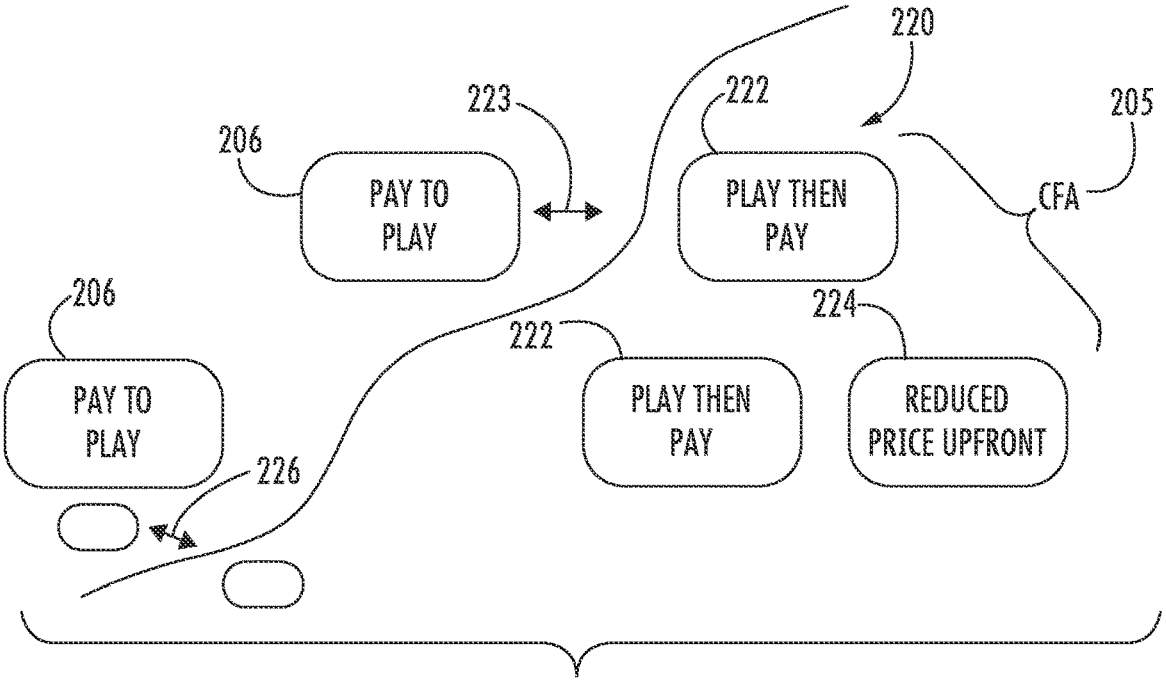
FIG. 2A is a conceptual diagram of possible screens in accordance with what is proposed herein.
Figure 3:
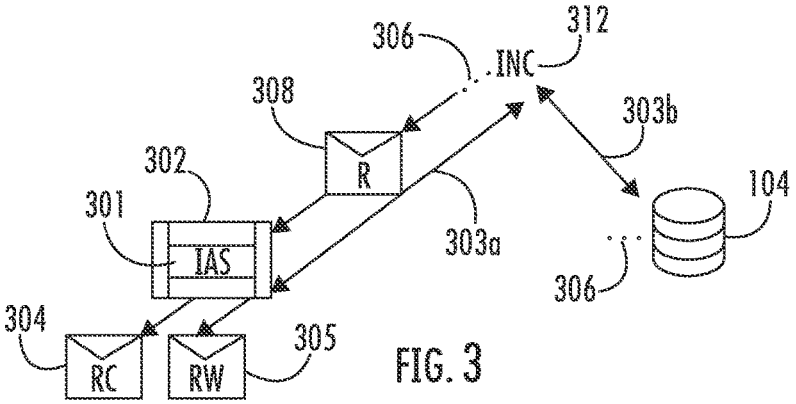
FIG. 3 is schematic diagram of communication in the system of FIG. 1A in accordance with what is proposed herein.
Figure 4A:
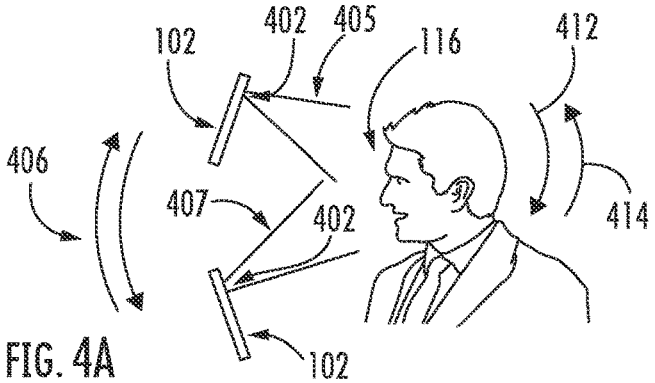
FIG. 4A is an illustrative and conceptual depiction of acquisition of information represented in FIG. 2C in accordance with what is proposed herein.
Figure 4B:
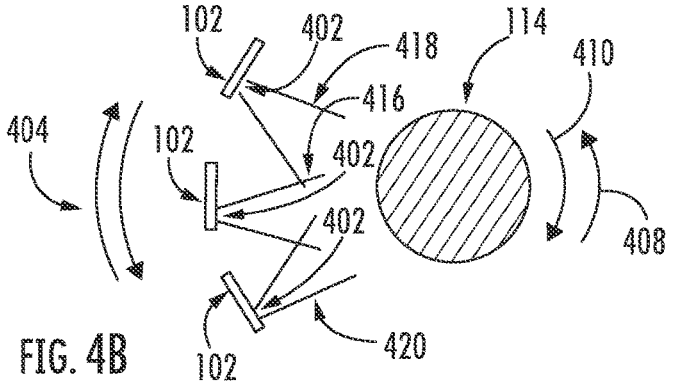
FIG. 4B is a top view corresponding to FIG. 4A but for acquisition from different angles in accordance with what is proposed herein.

The app offers the user 114 onscreen a "full-price upfront option" 206 of paying in full upfront, e.g., "Pay to Play", as seen in FIG. 2A. The payment is in exchange for the user 114 receiving from the lottery pick advising service 312 a suggestion as to, from among a set 208 of lottery numbers 210 possibly drawable in a particular upcoming lottery drawing 501, what one or more subsets 214 of the lottery numbers 210 to play 234 as respective one or more picks 212 in that particular upcoming lottery drawing 501.

Figure 2B:
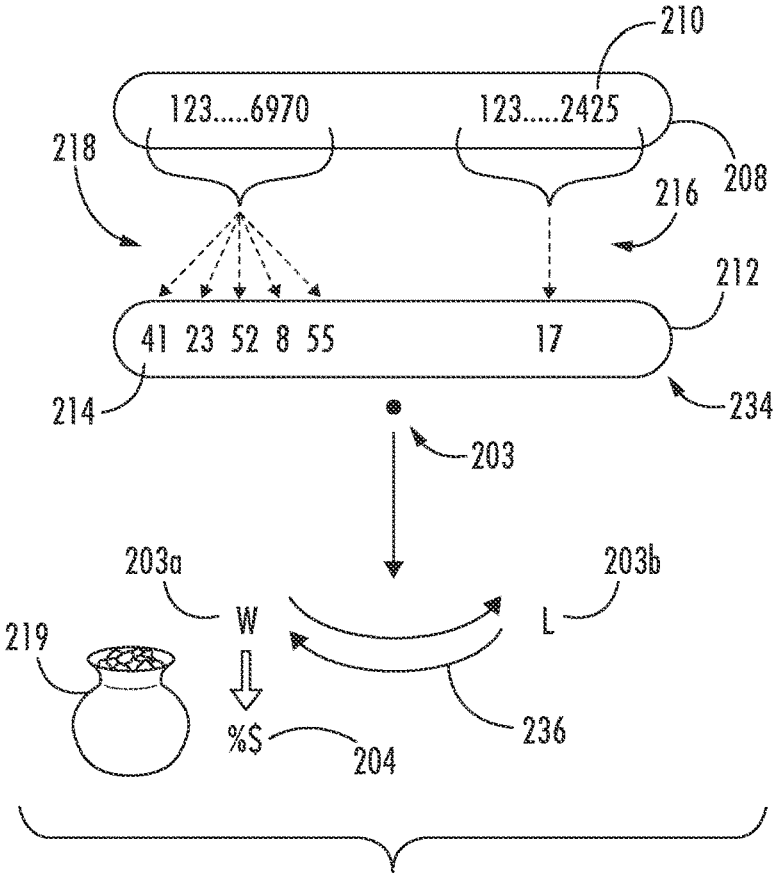
FIG. 2B is a conceptual depiction of lottery picks and possible outcomes in accordance with what is proposed herein.
Figure 2C:
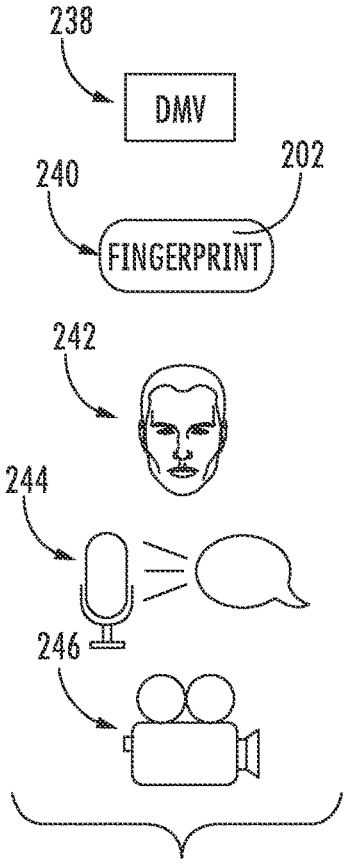
FIG. 2C is a conceptual illustration of different types of information acquired from the user in accordance with what is proposed herein.

An example of a suggested pick 212 is seen in FIG. 2B. MEGA MILLIONS is the service mark of the lottery used in this example, although USA POWERBALL, EURO MILLIONS, PICK-6 or the lottery of any state, country, or other administrative entity would apply. The set 208 of lottery numbers 210 depicted includes the numbers 210 from 1 to 70 and, in addition, the numbers 210 from 1 to 25, for a total of 95 numbers 210. Five numbers 210 are selected from the pool of numbers 210 from 1 to 70. A selection of a single number 210 is made, in addition, from the pool of numbers 210 from 1 to 25. Those six selected numbers 210 collectively constitute a suggested pick 212. The six numbers 210 are a subset 214 of the set 208 of 95 lottery numbers 210 (i.e., 1 to 70 AND 1 to 25) possibly drawable in a particular upcoming lottery 216. Each lottery ticket represents its own pick. The six selected numbers 210 shown constitute a suggested pick 212, i.e., a pick suggested by the lottery pick advising service 312. Generally, in making a suggestion 218, a number of picks 212 are suggested in exchange for the payment and/or conditional commitment 203, although a single pick 212 may be suggested.

The user 114 is free to and may (as mentioned below) be required to, on his or her own purchase the respective lottery tickets, one for each suggested pick 212. This purchase can be made at any authorized lottery retailer.

"Pay to Play" is the "full-price upfront" option 206. Onscreen there may be displayed, in addition and alongside this option, an alternative option 220 of "free-of-charge upfront" 222, i.e., "Play then Pay." The alternative option 220 may instead be "reduced price upfront" 224 displayable as "Reduced Price Upfront" or "Reduced Payment Upfront." Or the alternative option 220 displayed might include both of these latter options 222, 224. The alternative option 220 may be displayed directly alongside 223 the full-price upfront option 206. More generally, it is at least partially alongside 226 the full-price upfront option 206, e.g., slightly diagonal to the full-price option 206. Thus, the displayed options might include "Pay to Play" as the "full-price upfront" option 206 and, alongside this, the alternative option 220 of "Play then Pay" and/or "Reduced Price Upfront", i.e., the "free-of-charge upfront" and "reduced price upfront" options 222, 224. It is within the intended scope of the invention that the options 206, 222, 224 need not appear side-by-side. They can be above and below, or in any other configuration. They could also be displayed serially, rather than concurrently. In the instant embodiment, the suggestion 218 to be received is the same regardless of whether the user 114 takes the full-price upfront option 206 or the alternative option 220. In other words, the suggestion 218 received in exchange for payment of the full-price upfront option 206 is the same as the suggestion 218 received under the alternative option 220. The suggestion 218 to be received is also the same whether the user 114 opts for free-of-charge upfront 222 or reduced price upfront 224. It is, however, possible, in some embodiments of what is being proposed, for the suggestion 218 to differ depending on whether the user 114 has chosen the full-price upfront option 206 or the alternative option 220. If the alternative option 220 is chosen, the suggestion 218 might also differ depending on whether the user 114 has opted for free-of-charge upfront 222 or reduced price upfront 224.

The alternative option 220 involves the contingency fee arrangement 205 described herein above. In particular, as will be discussed in further detail below, the user 114 is conditionally committing 203, dependent on an outcome of that particular upcoming lottery drawing 501, to provide the lottery pick advising service 312 compensation for the suggestion 218, i.e., the suggested pick(s) 212. Specifically, part of the winnings 219 of the user 114 (20% in FIG. 1C although it may be 15%, 25% or any other percentage) for any pick(s) 212 the app suggested to the user 114 is, if there are any such winnings 219, committed to the lottery pick advising service 312. Ordinarily, the part of the winnings 219 committed to the lottery pick advising service 312 would be smaller under reduced price upfront 224 than it would be under free-of-charge upfront 222. Instead of agreeing to share a percentage of the winnings 219, the user 114 can, in compensation, contractually obligate himself or herself to, in lieu of sharing the winnings 219, buying to a given extent from the lottery pick advising service 312 suggested picks 212 for future drawings of the same lottery or different lotteries.

Figure 5:
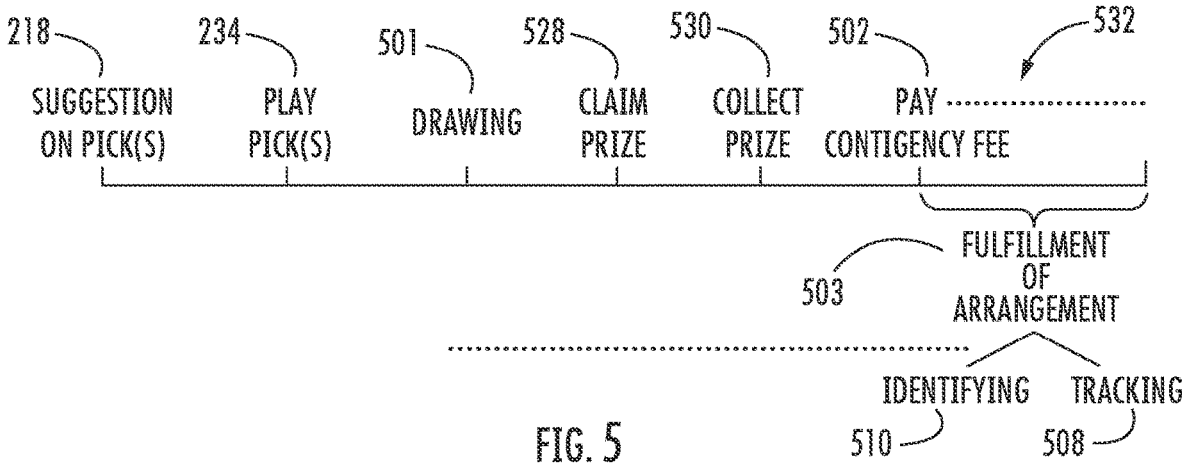
FIG. 5 is an annotated timeline corresponding to FIG. 2B and later events for lottery winners in accordance with what is proposed herein.

FIG. 5 shows a sample timeline starting from the pick suggestion(s) 218 until the contingency fee 204 is paid 502 (the horizontal dotted line to the right indicating late payment) or recovered 532. The user 114 typically would, if he or she has won, claim 528 and collect 530 the lottery prize. He or she would then send, or otherwise provide to the lottery pick advising service 312, part of the user's winnings 219 in compensation for the suggestion 218. Payment 502 may be sent proactively or responsive to a "reminder of the conditional commitment" 304 with respect to what was the particular upcoming lottery drawing 501, or a "reminder of a win" 305 in what was the particular upcoming lottery drawing 501, from the app or otherwise from lottery pick advising service 312. Winnings 219 under this contingency fee arrangement 205 might mean only winnings 219 of sufficient size or a jackpot, for example. The app may be programmed to communicate the reminder 304, 305 via the screen 106 alone, or the app be programmed differently so that, for example, communication of the reminder 304, 305 is via the audio speaker 130 alone. Or, for instance, the app may be written such that it communicates the reminder 304, 305, by default, both on the screen 106 and over the audio speaker 130. This default setting may be subject to change by the user 114.

The contingency fee arrangement 205 may provide that the user 114 consents to the lottery pick advising service 312, if the he or she wins 203*a* in the particular upcoming lottery drawing 501, monitoring the user's whereabouts during a time interval between the particular upcoming lottery drawing 501 and payment 502 of the contingency fee 204. Thus, FIG. 5 shows a line of dots representing this period of potential monitoring. The contingency fee arrangement 205 may further provide that the player hereby consents to entry of judgment against him/her in a particular court having jurisdiction if he/she fails to pay 502 the contingency fee 204 on time (i.e., a specified interval after the lottery prize is available to him or her). Any intelligence gathered during the monitoring is confidential and used only for tracking 508 and/or identifying 510 the winner in the event the winner is in default, i.e., fails to pay 502 the contingency fee 204 on time. The specified period may for example be 60 days, because the check when awarded and deposited may take weeks to clear. As a precaution to meet the requirements of some foreign jurisdictions (i.e., outside the country), the contingency fee arrangement 205 may authorize the lottery pick advising service's agent to accept service of process on the winner. The contingency fee arrangement 205 can also provide that reasonable expenses incurred in collecting the judgment may be charged. The contingency fee arrangement 205 foregoes punitive damages which some foreign jurisdictions disfavor. Fingerprints 202 and facial images 242 may be matched to DMV records to find or verify motor vehicles used by the winner. Global positioning system (GPS) tracking devices may be placed on the motor vehicle (e.g., surreptitiously planted onto the undercarriage), given the consent to being monitored. Private investigation personnel in parked cars outside the winner's residence can be dispatched to the airport (when proximity is detected via GPS) to visually check for the winner whether walking, sitting somewhere or waiting on line, and to observe from the displays flight times and destinations. It can also be observed what gate the winner enters and at what time. These measures can be employed to predict the destination country in which local counsel will seek to gain recognition and enforcement of the U.S.-based judgment, entry of which the winner contractually consented to via execution of the contingency fee arrangement 205. The biometric data can further be used in tracking 508 and/or identifying 510 the winner in the foreign country. A private investigator could, for instance, obtain a fingerprint 202 from a glass a customer held in a restaurant.

Fulfillment 503 of the contingency fee arrangement 205 is achieved through payment 502 of the contingency fee 204 on time or late, or when the contingency fee 204 is recovered 532.

A user 114 would be obligated to pay 502 the contingency fee 204 only for a suggested pick 212 that won 203*a* for the lottery drawing 501 and perhaps only if the user 114 benefited, directly or indirectly, at least in part from the winnings 219.

Alternatively, the user 114 might be obligated to play 234 the suggested pick(s) 212, and to claim 528 and collect 530 his winnings 219 within the time limit(s) provided by the lottery administration or government entity, and there might exist further restrictions on revealing the suggested pick(s) 212 to others before the drawing 501. Consequently, if the obligation to play 234 exists, a contingency fee 204 the user 114 is to provide, in compensation, to the lottery pick advising service 312 when a pick 212 that the lottery pick advising service 312 suggested to him wins 203*a*, in the particular lottery drawing 501, is based on the winnings 219 the user 114 is entitled to claim 528 and collect 530 if, in accordance with the contingency fee arrangement 205, the user 114 did play 234 (i.e., purchase a lottery ticket for), or were have to played 234, the winning pick 236. The requirement that the user 114 play 234 the pick 236 disincentivizes a user 114 avoiding the conditional commitment 203 by passing on a suggested pick 212 to a friend, relative, or business associate. The requirement to keep the suggestion 218 confidential protects against this too and, in addition, against a passed-on pick 212 resulting in a shared prize and thereby diluting the payout upon which the contingency fee 204 is based.

The app may present the contingency fee arrangement 205, including the above provisions, to the user 114 for acceptance, as by clicking on an "I Accept" soft button after digitally signing the arrangement 205. The app may, in addition, ask the user 114 to record himself verbally reciting 132 a statement of conditional commitment 203 to pay 502 the contingency fee 204. Although, as mentioned above, a "Pay to Play" user using a verified payment account need not enter into a contingency fee arrangement 205 or be subject to the above-described restrictions.

The app can be designed to be responsive to a remotely-originating winner-reminding input message 308. The message 308 may be sent from a lottery pick advising service 312 remotely located 306 from the user 114. In particular, the lottery pick advising service 312 will monitor each pick 212 it suggests to customers. When it detects visually (e.g., from a display of winning lottery numbers 210), electronically, or otherwise that a pick 212 has won, the lottery pick advising service 312 will transmit the winner-reminding input message 308. Responsive to the message 308, the app may communicate a reminder 305 via the screen 106, an audio speaker 130, or both the screen 106 and the audio speaker 130. The reminder 305 to be communicated is a "reminder of a win." Via any of the same means, the app may further communicate, if the alternative option 220 was accepted, a reminder 304 of the conditional commitment 203. The reminder 304 of the conditional commitment 203 might only apply and be sent if, for example, the win 203*a* was big enough, i.e., greater than a given threshold, such as $25,000 or $250,000.

Also, by any of the same means, the app can, during the identity authentication session 301, ask the user 114 to, in exchange for the suggestion 218, furnish information 238, 240, 242, 244, 246, such as the biometric information depicted, by which the user 114 can, after the particular upcoming lottery drawing 501, be tracked 508 and identified 510.

This information 238-246 is usable in the event the user 114 is not forthcoming in meeting his or her conditional commitment 203. This includes not responding to a winner-reminding input message 308 from the lottery pick advising service 312, i.e., specifically to the resulting application computer program issued reminders 304, 305, or not responding to inquiries directly from the lottery pick advising service 312.

By any of the same asking means, the app can further ask the user 114 to proceed such that the information 238-246 by which the user 114 can, after the upcoming lottery drawing 501, be tracked 508 and identified 510 includes each of: an "image of a front side of a driver's license" 238 of the user 114; an image 240 of the user's fingerprint 202; a live facial image 242 taken live from the user's face 116; an audio recording 244 of the user's voice; and a video recording 246 of the user's face 116 for which the viewpoint 402 shifts laterally 404, followed by shifting vertically 406 (e.g., between downward view 405 and upward view 407), or alternatively shifts vertically 406 first followed by shifting laterally 404. The app can instead ask for fewer than all of the above items. For example, the app may be configured to ask, by any of the same asking means mentioned herein above, the user 114 to proceed such that the information 238-246 includes at least one of: the image of a front side of a driver's license 238 of the user 114, the image 240 of the user's fingerprint 202, and the live facial image 242 taken live from the user's face 116. As mentioned further below, liveness is checkable by a number of means such as relying on image exchange between the user's phone and his or her eye. Some types of liveness checking include checking for three-dimensionality of the face 116 being imaged. Three-dimensionality checking can, for instance, be based on images that are captured by a phone having two front-facing cameras and stereoscopically merged.

The processor-executable code is further configured to ask, by any of the same means, the user 114 to, for example via the video recording device 128, record video 246 that includes a stream of images 242 of the user's face 116: a) while the user 114 verbally recites 132 the conditional commitment 203; b) as the user's face 116 turns, in any order, to the left 408, to the right 410, up 412, and down 414; or both a) and b).

The information 238-246 by which the user 114 can, after the upcoming lottery drawing 501, be tracked 508 and identified 510 may include: a stream of images 242 of the user's face 116 while the user 114 verbally recites 132 the conditional commitment 203; and an audio recording 244 of the user's speech 134 in making the verbal recitation 132. The processor-executable code is further configured to ask, by any of the same asking means referred to herein above, that video 246 be taken from a viewpoint 402 that shifts laterally 404. The shifting 404 is such that image acquisition transitions between a front view 416 and side view 418. The shifting motion can continue and can further be such that image acquisition transitions from the side view 418 of one side of the user's face 116 to the front view 416 of the user's face 116 and then to an opposite side view 420 of the other side of the user's face 116. The shape of the ear can therefore be recorded and is another possible biometric identifier, and thus would constitute part of the information 238-246 by which the user 114 can, after the upcoming lottery drawing 501, be tracked 508 and identified 510. Iris recognition and retinal scanning are other possibilities for phones having an infrared camera. Palm vein recognition is also implementable on a phone with infrared scanning such as the LG smartphone marketed as G8 THINQ which uses a front-facing camera for this function. Thus, the user 114 can be asked to scan his/her palm as part of an identity authentication session 301.

Methods, according to aspects of the invention, are analogous to the system 100 as described herein above.

For a computing device which includes a screen 106 and a front-facing camera 108, a method of advising a user 114 of a lottery pick advising service 312 accordingly, in an exemplary aspect, includes offering onscreen, by the lottery pick advising service 312 via an application computer program 302, the user 114 a full-price upfront option 206 of paying in full upfront. The payment 502 is in exchange for receiving, from the lottery pick advising service 312 via the screen 106, a suggestion 218 as to, from among a set 208 of lottery numbers 210 possibly drawable in a particular upcoming lottery drawing 501, what one or more subsets 214 of the lottery numbers 210 to play 234 as respective one or more picks 212 in the particular upcoming lottery drawing 501. The method further includes offering onscreen, by the lottery pick advising service 312 via the application computer program 302, the user 114 an alternative option 220 of at a reduced price upfront 224 and/or free-of-charge upfront 222 receiving from the lottery pick advising service 312 a suggestion 218. The suggestion 218 is as to, from among the set 208 of lottery numbers 210 possibly drawable in the particular upcoming lottery drawing 501, what one or more subsets 214 of the lottery numbers 210 to play 234. The one or more subsets 214 are to be played 234 as respective one or more picks 212 in the particular upcoming lottery drawing 501. The method additionally entails, during, and as part of, an identity authentication session 301 of the application computer program 302, capturing, for identity authentication, an image 242 of the user's face 116 with the front-facing camera 108 such that the user's face 116 is facing 118 the screen 106, an image 240 of a fingerprint 202 of the user 114, or both types of images. The capturing of the image 240 of the fingerprint 202 is via the front-facing camera 108, another camera 122, a fingerprint scanner 120, or any combination from among the three.

The method may further include, responsive to a remotely-originating winner-reminding input message 308 to the computing device 102, the app communicating a reminder 305 via the screen 106, an audio speaker 130, or both the screen 106 and the audio speaker 130. The reminder to be communicated is a reminder 305 of a win 203*a* in what was the particular upcoming lottery drawing 501. Via any of the same means, the app may further communicate, if the alternative option 220 was accepted, a reminder 304 of the conditional commitment 203.

The method may be such that, in accordance with the contingency fee arrangement 205, the user 114 is required to play 234 the suggested picks 212 the lottery pick advising service 312 provides to him. A contingency fee 204 the user 114 is to provide, in compensation, to the lottery pick advising service 312 when a suggested pick 212 wins 203*a* in the particular lottery drawing 501 is based on: the winnings 219 the user 114 is entitled to claim 528 and collect 530 if, in accordance with the contingency fee arrangement 205, the user 114 did play 234 the winning pick 236; or, if the user 114 did not play 234 the winning pick 236, the winnings 219 the user 114 would have been entitled to claim 528 if the user 114 were to have played 234 the winning pick 236.

The method also can include for example presenting, i.e., offering, on the screen 106 the alternative option 220 at least partially alongside 226 the full-price upfront option 206. The alternative option 220 may include receiving the suggestion 218 free-of-charge upfront 222 and/or at a reduced price upfront 224 such that the offering of the full-price upfront option 206 and the alternative option 220 entails displaying the full-price upfront option 206 and the alternative option 220 simultaneously.

In another aspect, also proposed herein is a computer readable medium embodying an application computer program 302 for lottery pick advising. The program 302 has instructions executable by a processor for performing a plurality of acts. From among these acts are the steps of the method as described in any, or any combination, of the above paragraphs.

Figure 6:
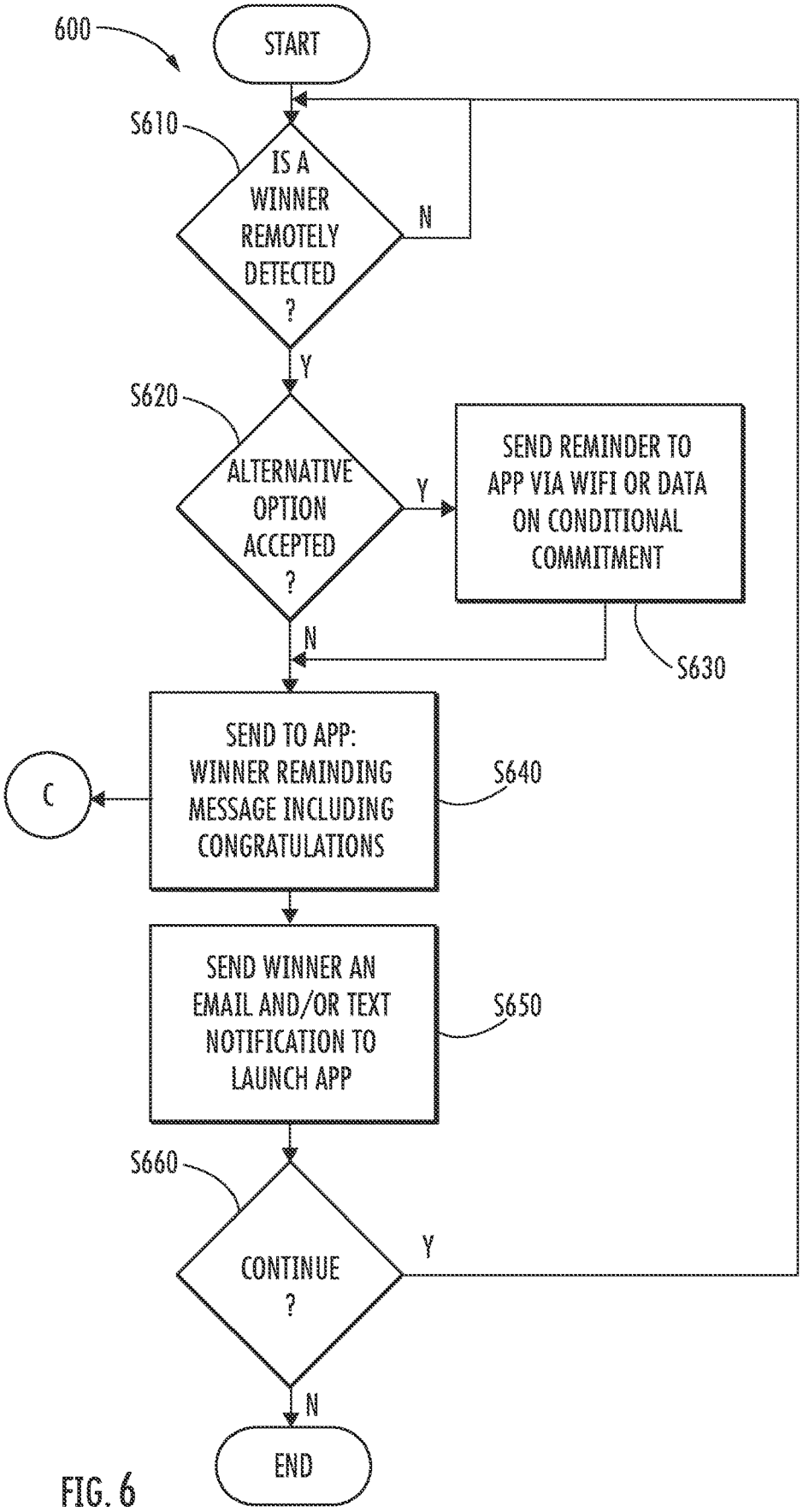
FIG. 6 is a flowchart of a lottery winner notification routine in accordance with what is proposed herein.

With reference to FIG. 6, a lottery winner notification routine 600 may execute at a site of the lottery pick advising service 312 remotely located 306 from the user 114. When a winner on a suggested pick 212 is remotely detected (step S610), the service checks whether the user 114 has selected the alternative option 220 (step S620). If the alternative option 220 has been selected (step S620), the app is sent a reminder 304 (step S630). The transmission may be by Wi-Fi, GSM, CDMA, or any other communication protocol. The reminder 304 is on the conditional commitment 203 the user 114 has made. Regardless of whether the alternative option 220 has been selected, the lottery pick advising service 312 sends to the app a winner-reminding input message 308 causing the app to responsively generate a reminder 305 of a win 203*a*. The reminder 305 includes congratulations for having won (denoted on FIG. 8 by the symbol "C") (step S640). The lottery pick advising service 312 also notifies the winner, by email and/or text, to launch the app (step S650). The lottery pick advising service 312 may also make a congratulatory phone call to the winner. This may include a reminder to claim 528 the prize and details on the procedure in the state sponsoring the lottery for claiming 528 and receiving the money. Monitoring for a winner can continue by branching back to step S610 (step S660).

Figure 7:
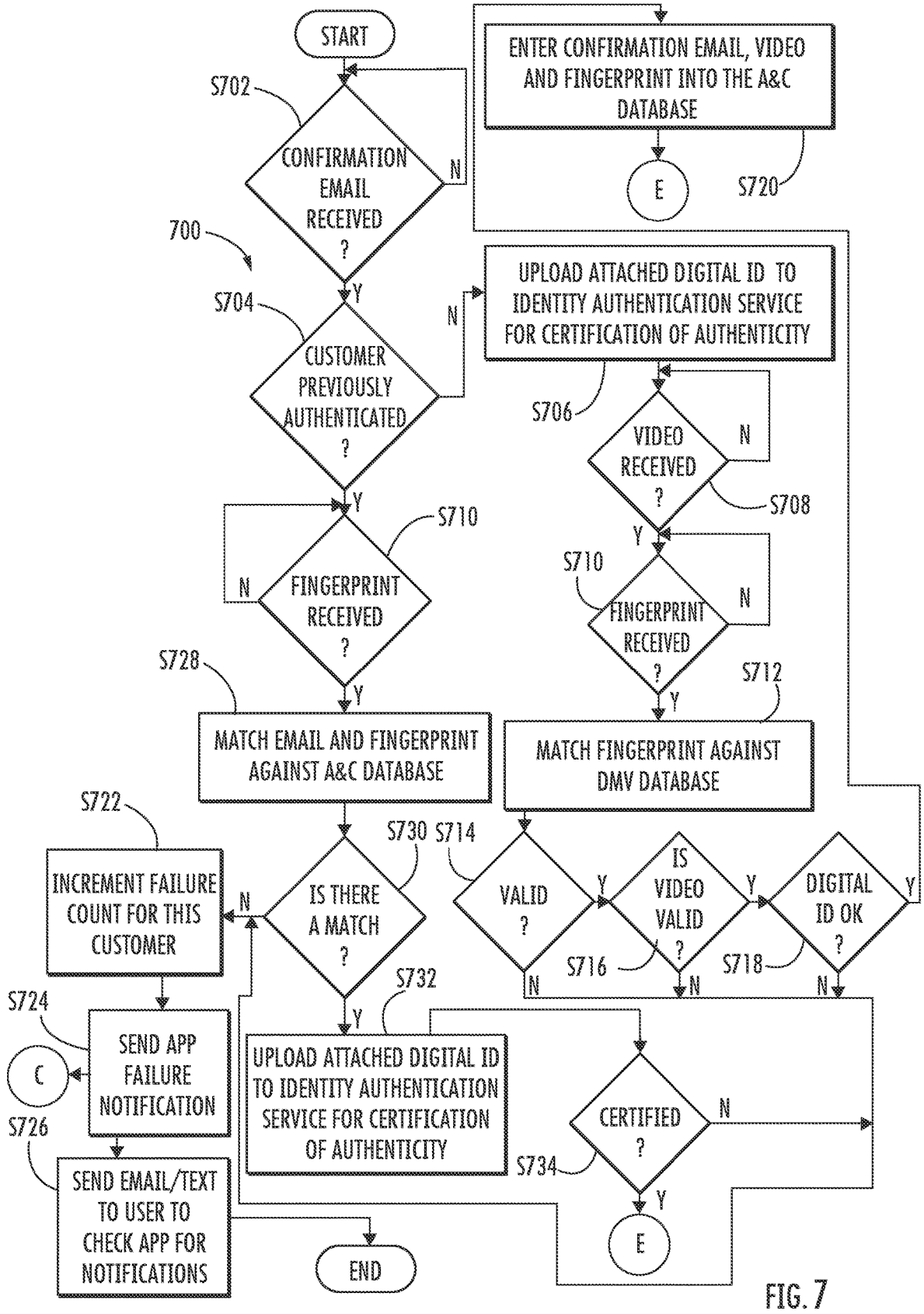
FIG. 7 is a flowchart of an ID authentication routine in accordance with what is proposed herein.

With reference to FIG. 7, an identity (ID) authentication routine 700 may execute at a site of the lottery pick advising service 312. This site is in general remotely located 306 from the user 114. The ID authentication routine 700 receives a confirmation email message that the user 114 has forwarded during, and as part of, an identity authentication session 301 of the lottery pick advising app (step S702). It has been forwarded from the user's computing device 102 (such as from a cell phone) from what is termed the "access email address", i.e., the user's email address. The user 114 received the confirmation email message at the access email address from an identity authentication service, such as that provided in conjunction with face authentication software under the brand FACETEC (www.facetec.com). Attached to the confirmation email message that the user 114 received was a digital ID that includes a picture of the front of the user's driver's license 238 and further contains an image 242 of the user's face 116. The user 114 scanned both of these images earlier, during and as part of the identity authentication session 301. The digital ID further conveys the access email address so that a recipient of the digital ID, who is using the digital ID to authenticate the identity of the transmitter, can confirm that this email address is the source email address. The fact that the user 114 has now received a confirmation email, with its attached digital ID, means that the identity authentication service has certified the user's authenticity. There can yet be further steps the lottery pick advising service 312 takes to certify authenticity.

The digital ID certifies that the user's face 116 that has been imaged is live rather than, for instance a puppet having a similar face.

It also certifies that a visual match has been determined to exist between the user's live facial image 242 and his or her driver's license photo scanned from his or her phone for example.

The digital ID additionally assures, by virtue of your receipt of it transmitted from the access email address, that the sender is the individual described and depicted in the digital ID which has inscribed in it that same access email address.

Detection of the liveness of a facial image is discussed in U.S. Patent Application No. 2019/0303551 to Tussy (hereinafter "Tussy '551"). Liveness detection adds time-efficient robustness to identity detection. A liveness check of the user's facial image can entail projecting an image from the phone's screen 106 to reflect off the user's eye. The reflected image is captured by the phone for analysis, as in Tussy '551 paragraph [0015]. Eye movement and blinking may be subject to criteria for establishing liveness, as in U.S. Pat. No. 10,803,160 (hereinafter "Tussy '160") to Tussy. Alternatively, or in addition, the acquisition of images 242 of the user's face 116 is done at different distances to distinguish a two-dimensional picture of a face from a three-dimensional face. A curved lens of the camera creates barrel distortion that varies with the distance to the object being imaged. Barrel distortion, i.e., the "fish-eye effect", is also described in U.S. Pat. No. 10,776,471 and U.S. Patent Application No. 2020/0394290, both to Tussy. The barrel distortion effect on biometric measurements is, as noted in Tussy '160, more substantial and noticeable for an image of a person's face when the imaging is from up close. The size of a person's nose in relation to the face appears greater when the lens is closer to the face. Alternatively, or in addition, the acquisition of images of the user's face 116 is done at different distances/angles so that, in conjunction with movement sensor output from the phone, liveness can be detected by comparing the below-described "initial ID authentication" to the "subsequent ID authentication" if these two sessions 301 respectively incorporate the Tussy '551 enrollment and authentication, as per Tussy '551 paragraphs [0006], [0007], and [0017]. Input for a liveness check may be video 246 or still images. See Tussy '551 paragraphs [0085], [0110], [0214]-[0216]. The entire disclosure of the patent documents mentioned in this paragraph are hereby incorporated herein by reference.

During and as part of the lottery pick advising app's identity authentication session 301, the identity authentication service may be sent the scanned license photo and the scanned image 242 of the user's face 116 for comparison. Based in part on the comparison, the user 114 is sent the confirmation email.

Alternatively, the scanned facial data can be compared instead locally on the phone to the scanned image of the license 238, as Tussy '551 notes in paragraph [0006], if the lottery pick advising app is locally equipped with the associated image processing capabilities.

As a further alternative, the app may, for security purposes, generate for the scanned license image a Tussy '551 "trusted template" for uploading to the identity authentication service as in Tussy '551 paragraph [0284]. This assumes that the app is outfitted with the associated image processing capabilities to form the template. The scanned driver's license photo may correspond to the "trusted image" in paragraph [0272] of Tussy '551. A trusted image is an image from a trusted source, such as a Department of Motor Vehicles (DMV). The trusted template is a biometric template of a trusted image. A biometric template can be generated using image recognition to produce a smaller data file, from which the original image cannot be retrieved, but which contains sufficient data from which to make a comparison indicating acknowledgment or denial of authentication.

Or identity authentication could be done directly by the lottery pick advising service 312 or could be done by another service-providing entity.

With reference again to FIG. 7, if the lottery pick advising service 312 has not previously authenticated the user's identity (step S704), the lottery pick advising service 312 uploads to the identity authentication service (e.g., to IDCheck.FaceTec.com) the digital ID that is attached to the confirmation email the lottery pick advising service 312 just received from the user 114 (step S706). The lottery pick advising service 312 thereby submits the digital ID for validation, i.e., that the digital ID has not been tampered with since the identity authentication service originally issued it. The validation can entail comparing hashes, i.e., hashed values, of the digital ID images, in particular the driver's license photo and the live facial image 242, taken by the identity authentication service before forming the digital ID to hashes of the images the identity authentication service is now receiving for validation. It can also entail matching the source email address of the forwarded confirmation email against the access email address the identity authentication service has saved and against that same access email address inscribed on the digital ID. The ID authentication routine can then wait unless or until the user's video 246 and fingerprint 202 have both been received at the lottery pick advising service 312 (steps S708 and S710). The fingerprint 202 may be matched against a DMV database (step S712). Thus, even if the user's cell phone were to be used by someone else in attempting authentication by the identity authentication service, the fingerprint 202 obtained live on the phone during the identity authentication session 301 would fail to match the DMV records. In addition, obtaining the fingerprint 202 of the person making the transaction in this manner who subsequently is ID authenticated contributes to relieving the tracking burden. The process of obtaining the user's fingerprint 202 live on the phone is discussed further below. If the fingerprint 202 matches against the DMV records (step S714), query is made as to the validity of the video (step S716). In particular, the lottery pick advising app may have reviewed the video 246 for liveness based on images captured when the user 114 was facing 118 the screen 106. For example, a screen image reflected off the user's eye can be acquired, or the user 114 could have been instructed to vary phone-to-camera distance. Facial recognition is best done from a front view of the face. A more in-depth examination of the video 246 may subsequently be made by the lottery pick advising service 312, to check that that the video content meets their requirements which have been communicated to the user 114, before ID authentication is deemed to be complete. If the fingerprint 202, and video 246 are deemed valid (steps S714, S716), query is made as to whether the digital ID has been authenticated (step S718), as described further above. If the digital ID has been authenticated (step S718), the digital ID, fingerprint 202, and video 246 are entered into the Authentication and Collections (A&C) Database 104. The confirmation email that conveyed the digital ID may also be entered into the A&C Database 104 (step S720). The user 114 is instructed (as seen on FIG. 10 for entry point E) that he or she will be notified, as by email and/or text, when ID authentication is complete. In the meantime, the lottery pick advising service 312 can check the video content against the requirements. If, on the other hand, ID authentication fails due to the fingerprint 202 being unacceptable (step S714) or the initial check of the video 246 finding the video 246 unacceptable (step S716), a failure count for the user 114 is incremented (step S722). In this case, a failure notification is sent to the app (denoted in FIG. 8 by the symbol "C") (step S724). An email and/or text is sent to the user 114 to check the app for notifications (step S726). The lottery pick advising service 312 maintains in the A&C Database 104 a failure count for each user 114. In an alternative embodiment, instead of the app accessing the fingerprint data scanned by the computing device 102, the app can rely on the fingerprint data being authenticated by a third party which then communicates the authentication success or failure to the app.

Figure 10:
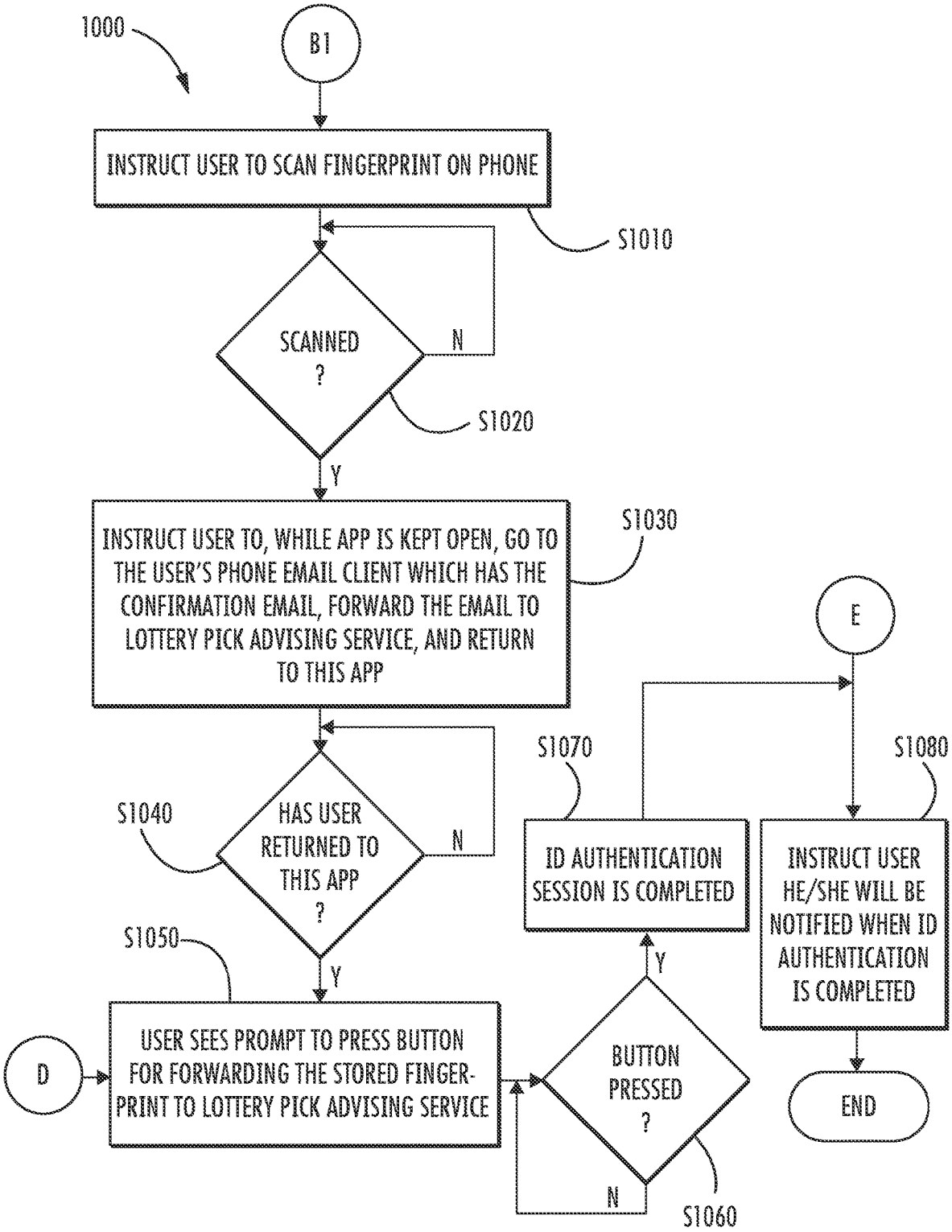
FIG. 10 is a flowchart of a subsequent ID authentication routine in accordance with what is proposed herein.

If the user 114 from whom the identity authentication service email is received has instead previously undergone ID authentication successfully (step S704), the lottery pick advising service 312, once the fingerprint 202 is received (step S710), matches the email and the fingerprint 202 against the A&C Database 104 (step S728). Here, too, even if the user's cell phone were to be used by someone else in attempting authentication by the identity authentication service, the fingerprint 202 obtained live on the phone during the identity authentication session 301 would fail to match the DMV records. If the email and the fingerprint 202 both successfully match against the A&C Database 104 (step S730), the digital ID attached to the identity authentication service email is uploaded to the identity authentication service for certification of authenticity (step S732). If authenticity is here certified (step S734), the user 114 is instructed (as seen in FIG. 10 for entry point E) that he or she will be notified, as by email and/or text, when ID authentication is complete. If, on the other hand, the identity authentication service denies authenticity (steps S714, S716, S718, S734) or if either a match of the fingerprint 202 or email against the A&C database 104 is not successful (step S730), processing increments the failure count (step S722) and follows the above-indicated notification procedure for that event (S724).

Figure 8:
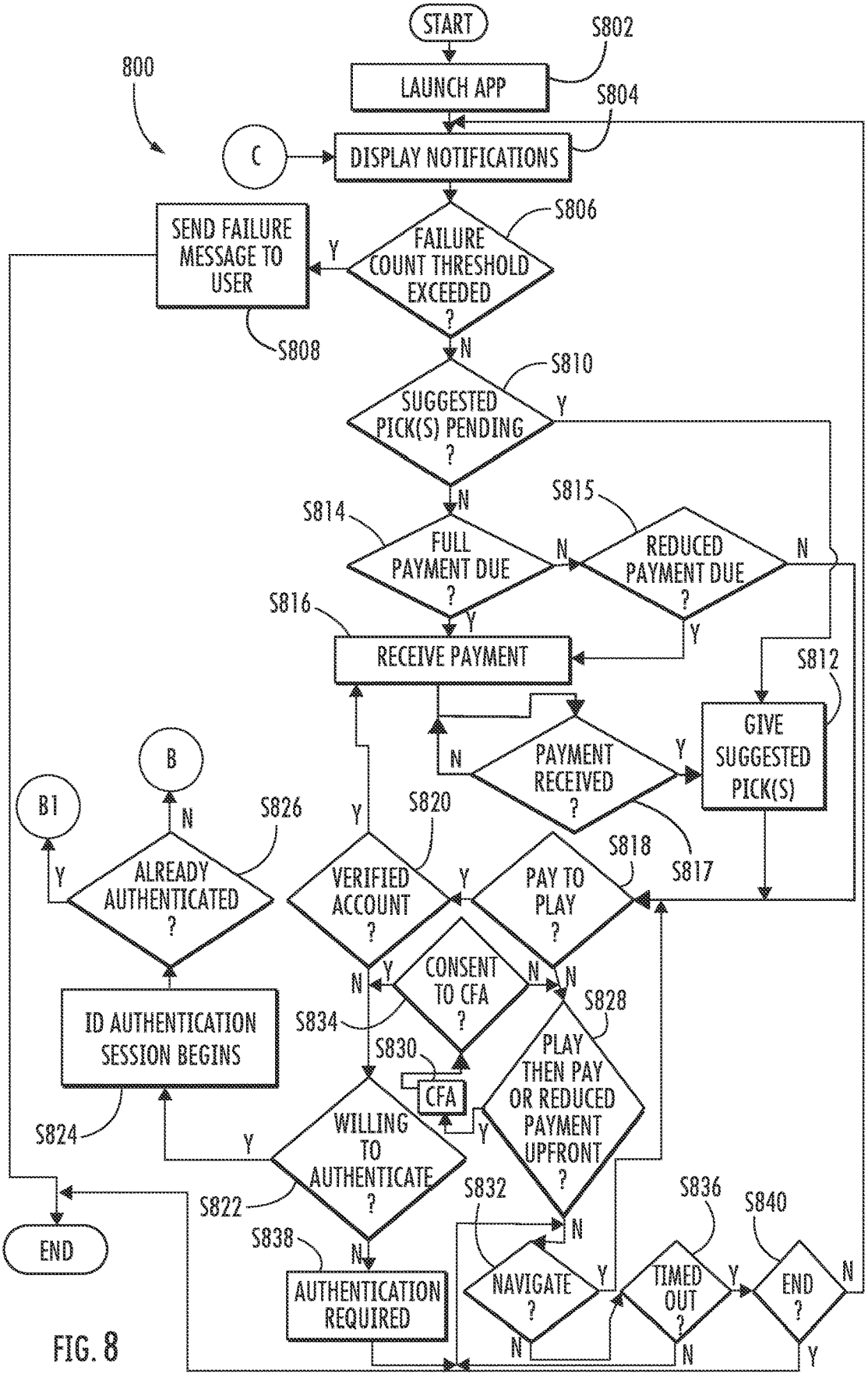
FIG. 8 is a flowchart of a main user app routine in accordance with what is proposed herein.

In accordance with the main user app routine 800 as seen in FIG. 8, a user 114 downloads the app. Upon launching the app (step S802), any notifications to the app (represented here by the symbol "C") are displayed to the user 114 (step S804). The failure event count is initially zero. It may, however, at this point be a positive integer if the user 114 previously used the app and failed ID authentication. Each failure increments the count by one. The failure event count is compared to the failure event count threshold. If the threshold is exceeded (step S806), a failure message is displayed and optionally sent to the user 114 by other means such as text or email message (step S808). If the threshold is not exceeded (step S806), query is made as to whether any one or more picks 212 suggested by the lottery pick advising service 312 are pending (step S810), due for instance as result of successful ID authentication.

It is possible at this point that the user 114 has previously used the app, has qualified for a suggested pick 212 through full-price upfront 206, did not successfully make payment 502 via the app (step S817), but subsequently paid the lottery pick advising service 312 directly. Alternatively, it may be the case that a free-of-charge upfront user has by this time had his/her identity authenticated (step S1150 in FIG. 11). In any event, if one or more suggested picks 212 are pending for the present user 114 (S810), they are now displayed or otherwise communicated to the user 114 (step S812).

Alternatively, the user 114 may be at the stage that he or she need only make payment 502 for the pick(s) 212 in order to receive them. In other words, a full-price upfront payment 502 is due or a reduced-price upfront payment 502 is due. Thus, for example, a reduced-price-upfront user may have been notified that his/her identity has been authenticated (step S1150). Or a reduced-price-upfront or full-price-upfront user 114 may have timed out in responding to a prompt from the app (such as at a timeout decision (at step S816). It could also be that the user's first attempt to pay 502 was unsuccessful. The user 114 is therefore prompted to make payment 502. The app may incorporate a facility for online payment 502 via a credit card, debit card, or verified account. If a full-price upfront payment 502 is due (step S814) or if a reduced-price upfront payment is due (step S815), payment 502 may be made using a touchscreen, keyboard, voice command, joystick, physical gesture, or any other known and suitable means. Alternatively, or in addition, the app could suggest to the user 114 that he/she call in to the lottery pick advising service 312 or otherwise make payment 502. In this case, the user 114 could enter the payment confirmation code. Once payment 502 is received (steps S816, S817), the one or more suggested pick(s) 212 are now displayed or otherwise communicated to the user 114 (step S812).

As a further alternative, this may be the user's initial use of the app (so that no pick is pending and no payment 502 is due), or the user's initial use of the app for the present suggested pick(s). Similarly, if the user 114 has just received his or her suggested pick(s) 212, he or she may want to get one or more additional suggested picks 212.

In any case, the user 114 is presented with the choice "Pay to Play" (step S818). This is typically displayed onscreen as the full-price upfront option 206. It may be concurrently accompanied onscreen by an alternative option 220 such as "Play then Pay" and/or "Reduced Price Upfront."

If "Pay to Play" is selected (step S818), the user 114 is given the choice to pay 502 using a verified account which the user 114 can utilize if he/she has a verified account.

If the user 114 opts to pay 502 using a verified account (step S820), processing returns to the step S816 in which the user 114 is to submit payment 502.

If, on the other hand, the user 114 answers that he/she will not be using a verified account (step S820), the user 114 is queried as to whether he/she is willing to authenticate his or her identity (step S822). If the user 114 is willing to authenticate his/her identity (step S822), the identity authentication session ("ID authentication session") 301 begins (step S824).

If the user 114 has been ID authenticated already (step S826), processing branches to entry point B1 (subsequent ID authentication routine 1000) and otherwise to entry point B (initial ID authentication routine 900).

If the user 114 has not selected "Pay to Play" (step S818) but has selected an alternative option 220, such as "Play then Pay" or "Reduced Price Upfront" (step S828), the user 114 at this point may be presented with a contingency fee arrangement 205 (step S830). Or, instead, this may be deferred, and the user 114 may be asked to scan his/her DMV driver's license.

It may be the case, however, that the user 114 is selecting neither "Pay to Play" (step S818) nor the alternative option 220 (step S828), but instead is electing to navigate elsewhere in the app (step S832), in order to look over the app for example before committing to anything. Among these pages could be ones touching, for instance, on any one or more of the following: mission statement, identifier login, two-step verification, user profile, lottery news, recent winners, pick customization, lottery-related content, and app rating.

If and when the user 114 decides to select the "Play then Pay" or "Reduced Price Upfront" option 222, 224 (step S828), the user 114 may, at this point, be presented with the contingency fee arrangement 205 (step S830) as mentioned herein above.

If the user 114 does not accept the contingency fee arrangement 205 (step S834), the user 114 will either navigate elsewhere (step S832) or time out (step S836). If the user 114 times out (step S836), the user 114 may (step S840) be returned to the app home page (step S804).

If the user 114 accepts the contingency fee arrangement 205 (step S834), the user 114 is asked, or may be asked if the willingness was not already part of the contingency fee arrangement document, whether he or she is willing to authenticate his/her identity (step S822).

If the user 114 is not willing to authenticate his/her identity (step S822), a screen message may say that ID authentication is required (step S838), and the user 114 will either navigate elsewhere (step S832) or time out (step S836).

If the user 114 is willing to authenticate his/her identity (step S822), the identity authentication session ("ID authentication session") 301 begins (step S824) and processing follows the path indicated herein above.

Figure 9:
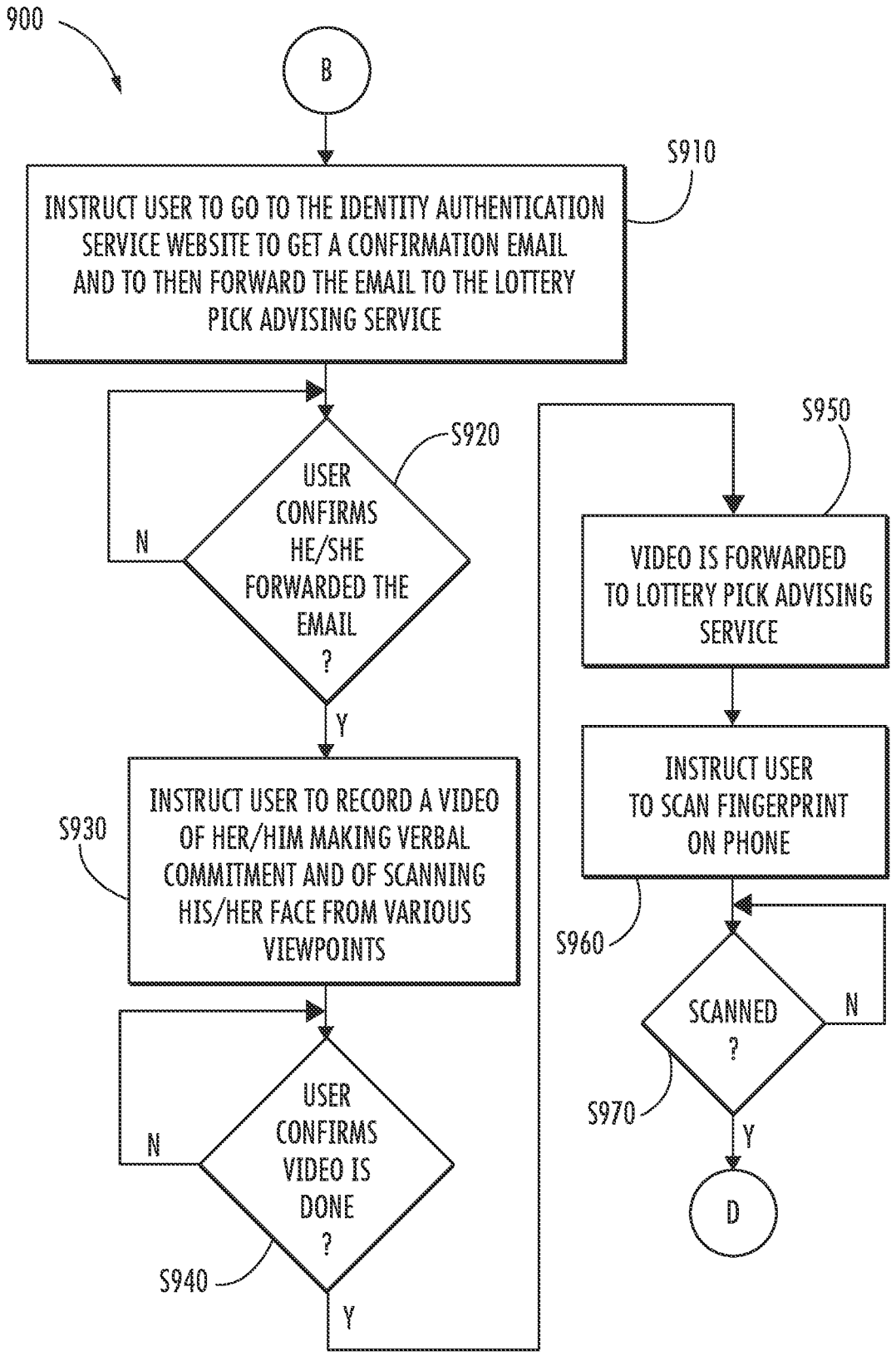
FIG. 9 is a flowchart of an initial ID authentication routine in accordance with what is proposed herein.

As seen in FIG. 9, in the initial ID authentication routine 900, the user 114 is instructed to go to the identity authentication service website (e.g., www.FaceTec.com) to get a digital ID. A link to the website may be provided by the app. In any event, the app remains idle waiting for the user 114 to return. At the website, the user 114 is prompted for his or her email address which is then designated as the access email address at which the user 114 will later receive the confirmation email. That email has as an attachment the digital ID on which the access email address is inscribed. The user 114 is further instructed to use their phone to capture, at different distances and/or angles, images 242 of their own face 116. These facial images 242 are used for liveness detection. The user 114 is further instructed to take a photo of the front of their DMV driver's license 238. The order of these operations may be different. The user 114 may be prompted, for instance, first to scan their DMV license, then to provide their email address, and then to take facial images. Authentication, by the identity authentication service, of the user 114 may be based on the license photo and the captured images, as described in Tussy '551 in conjunction with its FIG. 17. If the user 114 is at this point authenticated by the identity authentication service, the identity authentication service produces the digital ID as certification. The user 114 is further instructed to forward the email message from the identity authentication service, including the digital ID, to the lottery pick advising service 312 (step S910). As mentioned above, a digital ID of the user 114 is attached to the confirmation email message that the user 114 received from the identity authentication service. The user 114 has been advised that the digital ID remain attached to the confirmation email message that the user 114 is now forwarding to the lottery pick advising service 312.

When the user 114 returns to the app and confirms that he or she forwarded the confirmation email message with the digital ID attached (step S920), the app instructs the user 114, if an alternative-option user, to follow the directions onscreen to record a video 246 of himself or herself making a verbal commitment to, if he or she wins 203*a* the lottery or wins 203*a* a sufficient prize, pay 502 the contingency fee 204. Typically, a script of the verbal commitment would be provided onscreen for the user 114 to read out loud. Allowing for some pre-arranged wording that all users 114 recite facilitates voice recognition as an additional biometric identifier. As further instructed, the video 246 may, for any user, include a scan of his or her face 116 from various viewpoints 402 (step S930). As noted herein above, liveness checking can be done from still images. The video 246 which is comprised of many images from different distances and angles, and of audio, is acquired and stored for potential use in identifying 510 and/or tracking 508 a lottery winner who has not paid the contingency fee 204. When the user 114 confirms onscreen that the video 246 is done (step S940), the video 246 is forwarded to the lottery pick advising service 312 (step S950). The user 114 is instructed to scan his or her fingerprint 202 using his/her phone (step S960), typically the dedicated fingerprint sensor used to sign in to the phone. Many apps nowadays allow a user 114 to sign into the app using a fingerprint scan. The fingerprint data may be stored at least temporarily. It may be accessible to the app via intermediary software such as that sold under the trademark TRUSTZONE. When the scan is completed (step S970), processing goes to entry point D (see FIG. 10).

For any subsequent ID authentication (shown in FIG. 10), such as for a new transaction or subsequent suggested picks, the subsequent ID authentication routine 1000 streamlines the process in that neither a new selfie nor a new video 246 is required. The user 114 is, however, again prompted to scan his/her fingerprint 202 using the fingerprint scanner 120 (step S1010). When the scan is completed (step S1020), the app instructs the user 114 to, while the app is kept open, go the user's phone email client which has the confirmation email message. The app advises the user 114 to forward the email message to the lottery pick advising service 312 and to return to the app which has been kept open (step S1030). When the user 114 returns to the app (step S1040), the user 114 is (as seen from entry point D) presented with a prompt to forward the stored fingerprint 202 to the lottery pick advising service 312 (step S1050). A hash of the image may likewise be sent for storage and future comparison to a hash of the fingerprint 202 of the user 114 scanned at that time. When the user 114 responds by for instance pressing the onscreen soft button (step S1060), the subsequent ID authentication session ends in completion (step S1070). The app indicates to the user 114 that he or she will be notified when ID authentication has been completed (step S1080). For extra security, the image of the stored fingerprint 202 may be converted to a biometric template before being forwarded as in paragraph [0263] of Tussy '551, so that raw fingerprint data is not telecommunicated.

Optionally, the subsequent ID authentication routine 1000 can be designed to require the user 114 to move the phone to different positions relative to the user's head, as the user 114 did during the initial ID authentication routine 900, as in Tussy '551 paragraphs [0016]-[0017]. In this embodiment, the video 246 the user 114 took in the initial ID authentication routine 900 is used in an enrollment process described in Tussy '551 paragraphs [0006]-[0007]. Still images may be captured instead of video 246. Three-dimensionality detection and liveness checking can be based on a comparison of the acquired imaging from the initial and subsequent ID authentication routines 900, 1000.

Figure 11:
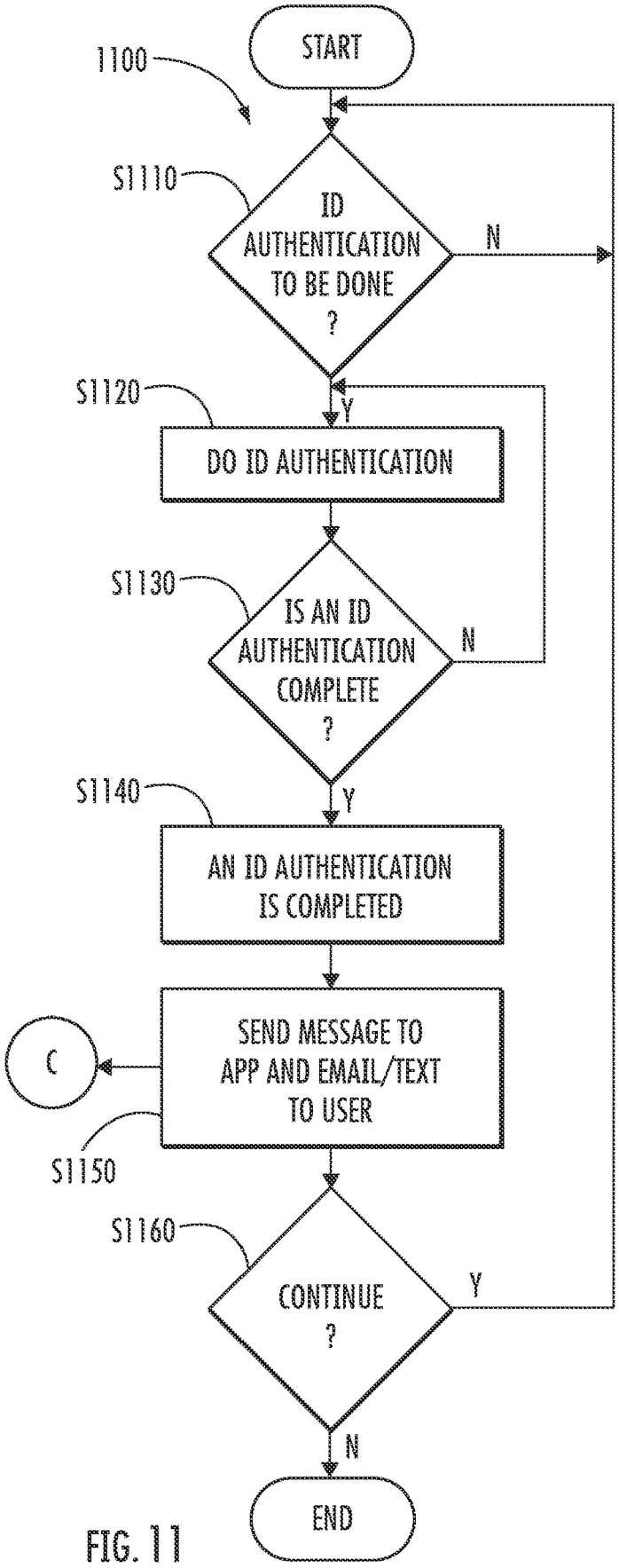
FIG. 11 is a flowchart of a user notification routine in accordance with what is proposed herein.

In a user notification routine 1100 as shown in FIG. 11, the lottery pick advising service 312 monitors, electronically, manually, or with various possible degrees of user intervention, when an ID authentication is ready to be done. When an ID authentication is ready to be done (step S1110), it is performed immediately or when resources (e.g., time, personnel) are available (step S1120). Here, a more careful review may be made of the video 246, e.g., as to whether all the required views are present, to assure a more complete biometric record for future lottery winner tracking 508 and/or identification 510. The lottery pick advising service 312 also monitors when an ID authentication has been completed (step S1130). When an ID authentication is completed (step S1140), the lottery pick advising service 312 notifies the app (represented here by the symbol C which is shown on FIG. 8) (step S1150), as by Wi-Fi or phone data, and notifies the user 114, as by email or text. Processing, if it is to continue, returns to the start of the user notification routine to monitor for ID authentication for other users 114 yet to be undertaken (step S1160).

A lottery pick advising system 100 includes a user-operable computing device 102 having a screen 106, front-facing camera 108, processor 110, and memory 112 comprising code of an application computer program 302, the code configured to: (a) as part of an identity authentication session 301 of the program 302, operate the computing device 102 to, during the identity authentication session 301, capture, for identity authentication: an image 240 of a fingerprint 202 of the user 114, an image 242 of the user's face 116 with the front-facing camera 108 such that the user's face 116 is facing 118 the screen 106, or both types of images 240, 242; (b) offer onscreen the user 114 a full-price upfront option 206 of paying in full upfront in exchange for receiving from a lottery pick advising service 312 a suggestion 218 as to, from among a set 208 of lottery numbers 210 possibly drawable in a particular upcoming lottery drawing 501, what one or more subsets 214 of the lottery numbers 210 to play 234 as respective one or more picks 212 in the drawing 501 and (c) offer as an onscreen alternative a contingency fee arrangement 205 of at a reduced price upfront 224 and/or free-of-charge upfront 222 receiving the suggestion 218 for which compensation is owed if he wins 203*a*. The captured images may aid in tracking 508 and/or identifying 510 the user 114 to assure fulfillment 503 of the contingency fee arrangement 205. Images acquired in the capturing are acquired for tracking the user 114 to assure 503 that fulfillment.

While the invention has been illustrated and described in detail in the drawings and foregoing description, such illustration and description are to be considered illustrative or exemplary and not restrictive; the invention is not limited to the disclosed embodiments.

For example, the contingency fee arrangement 205 could provide that the user 114 consents to the lottery pick advising service retaining the user's passport during the monitoring time-period.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope.

A computer program can be stored momentarily, temporarily or for a longer period of time on a suitable computer-readable medium, such as an optical storage medium or a solid-state medium. Such a medium is non-transitory only in the sense of not being a transitory, propagating signal, but includes other forms of computer-readable media such as register memory, processor cache and RAM.

A single processor or other unit may fulfill the functions of several items recited in the claims. The mere fact that certain measures are recited in mutually different dependent claims does not indicate that a combination of these measured cannot be used to advantage.

What is claimed is:

1. A computing device operable by a user for lottery pick advising comprising:

a screen, a front-facing camera, a processor, and a memory;

wherein the memory comprises a non-transitory computer-readable medium embodying processor-executable code of an application program;

wherein the processor-executable code is capable of being executed by the processor of the computing device; and wherein the processor-executable code includes instructions executable by the processor of the computing device for performing a plurality of acts, from among said plurality there being the acts of:

offering the user a full-price upfront option of paying in full upfront, wherein the payment is in exchange for the user receiving from a lottery pick advising service a suggestion on one or more picks to play in a particular upcoming lottery drawing;

offering the user an alternative option of at least one of at a reduced price upfront and free-of-charge upfront receiving by the user a suggestion from the lottery pick advising service on one or more picks to play in said particular upcoming lottery drawing, wherein the alternative option involves making, prior to said receiving under the alternative option, a contingency fee arrangement such that the user is, by accepting the alternative option, conditionally committing, dependent on an outcome of said particular upcoming lottery drawing, to, after said particular upcoming lottery drawing, provide, if there are winnings that are from said particular upcoming lottery drawing and from said suggestion, the lottery pick advising service in compensation, as a contingency fee, for said suggestion with a portion, that is less than all, of winnings the user receives from said particular lottery drawing from playing from said suggestion; and, as part of an identity authentication session of the application program, operating the computing device to, during the identity authentication session, capture, for identity authentication: an image of a fingerprint of the user, an image of the user's face with the front-facing camera such that the user's face is facing the screen, or both types of images;

wherein the operating to capture the image of the fingerprint, if the capturing of such is configured in the processor-executable code, operates any one or more of the front-facing camera, another camera, and a fingerprint scanner.

2. A system comprising the computing device of claim 1, said system further comprising a database remotely located from the computing device, wherein the database is utilized for receiving, for potential use in tracking the user to recover the contingency fee, identifying the user to recover the contingency fee, or both tracking and identifying the user to recover the contingency fee, the image of the user's face, the image of the user's fingerprint, or said both types of images.

3. The computing device of claim 1, wherein the computing device further includes an audio speaker; and wherein from among said plurality of acts there is the further act of, responsive to a remotely-originating winner-reminding input message for said particular upcoming lottery drawing, communicating, via the screen, an audio speaker, or both the screen and the audio speaker, a reminder of a win in what was said particular upcoming lottery drawing and, if the alternative option was accepted, a reminder of the conditional commitment.

4. The computing device of claim 1, wherein from among said plurality of acts there is the further act of presenting on the screen the alternative option at least partially alongside the full-price upfront option.

5. The computing device of claim 1, wherein the alternative option involves said receiving the suggestion at said reduced price upfront.

6. The computing device of claim 1, wherein the alternative option involves said receiving the suggestion free-of-charge upfront.

7. The computing device of claim 4, wherein from among said plurality of acts there is the further act of presenting on the screen the alternative option at least partially alongside the full-price upfront option.

8. The computing device of claim 1, wherein from among said plurality of acts there is the further act of asking, via the screen, an audio speaker, or both the screen and the audio speaker, the user to, in exchange for the suggestion under the alternative option, furnish information by which the user can, after the upcoming lottery drawing, be tracked and identified.

9. The computing device of claim 1, wherein the contingency fee arrangement provides that the user consents to the lottery pick advising service, if the user wins in the upcoming lottery drawing, monitoring the user's whereabouts during a time interval between the upcoming lottery drawing and payment of the contingency fee.

10. The computing device of claim 1, wherein said outcome is that said winnings that are from said particular upcoming lottery drawing and from said suggestion are of sufficient size.

11. The computing device of claim 10, wherein said winnings that are from said particular upcoming lottery drawing and from said suggestion are of sufficient size if said winnings that are from said particular upcoming lottery drawing and from said suggestion are from a jackpot.

12. The computing device of claim 1, wherein said at least one of at a reduced price upfront and free-of-charge upfront consists of free-of-charge upfront.

13. The computing device of claim 1, wherein the alternative option and the full-price upfront option are concurrently offered on the screen.

14. The computing device of claim 1, wherein specified size of said portion is part of the contingency fee arrangement made prior to said receiving of said suggestion.

15. The computing device of claim 1, wherein said contingency fee is based not only on said winnings the user receives, if any, but on winnings the user would be, after said particular upcoming lottery drawing, entitled to claim and collect if the user did play, or were to have played, in said particular upcoming lottery drawing under the alternative option said one or more picks from said suggestion.

16. The computing device of claim 1, wherein said suggestion under the alternative option is as to, from among a set of lottery numbers possibly drawable in said particular upcoming lottery drawing, what one or more subsets of the lottery numbers to play respectively as said one or more picks under the alternative option.

17. The computing device of claim 1, wherein the computing device is a mobile device operable by a user, the computing device comprising a video recording device that includes the front-facing camera and further includes an audio recording device that includes a microphone;

wherein the identity authentication session is commenced, if the user has not yet been identity authenticated, as an initial identity authentication session preceded by launch of the application program that serves as an app for the mobile device and thus may be downloadable from an online store to the mobile device and immediately installed for operation on the mobile device; and wherein, from among said plurality of acts, there are the further acts of:

asking the user, during the initial identity authentication session, to provide an access email address of an email client on the computing device;

scanning for an identity authentication service a trusted image of the user and, in addition, an image of the user's face with the front-facing camera such that the user's face is facing the screen;

instructing the user to go, while the application program is kept open for the user's return to the application program to complete the initial identity authentication session, to the email client on the computing device and forward, from the email client, a confirmation email message from the identity authentication service to the lottery pick advising service;

if the user has selected the alternative option, recording a video that includes a stream of images of the user's face while the user verbally recites the conditional commitment, the video including audio of the user's speech in making the verbal recitation; and operating the computing device to capture, for identity authentication, the image of a fingerprint of the user.

18. The computing device of claim 17, wherein, from among the plurality of acts, there is the further act of:

if the user has already been identity authenticated, instructing, during a subsequent identity authentication session of the application program, the user to, while the application program is kept open for the user's return to the application program to complete the subsequent identity authentication session, go to the email client to again forward, to the lottery pick advising service, the confirmation email message.

19. The computing device of claim 18, wherein the confirmation email message the user in both the initial and subsequent identity authentication sessions is instructed to forward is at the access email address, and a digital identifier certifying the user's authenticity and providing the access email address is attached to the confirmation email, the identity authentication service having created the digital identifier based on the scans of the user's face and the trusted image.

20. The computing device of claim 19, wherein the lottery pick advising service forwards, from the forwarded confirmation email message to the identity authentication service, the attached digital identifier providing the access email address; and the forwarding, as instructed during the initial and subsequent identity authentication sessions, of the confirmation email message therefore forwards the digital identifier, which provides the access email address, to the identity authentication service.

21. The computing device of claim 20, wherein the identity authentication service saves a copy of the access email address and wherein, in validating the digital identifier during the initial identity authentication session, the identity authentication service matches a source email address of a confirmation email message the user forwarded to the lottery pick advising service against said copy and against the access email address provided by the digital identifier.

22. The computing device of claim 19, wherein part of the initial identity authentication session, the subsequent identity authentication session, or both sessions is checking that the user has returned after being instructed to go to the email client, and then continuing activity of the respective session.

23. The computing device of claim 1, wherein said portion is within a range of 15 percent to 25 percent of said winnings the user receives.

24. The computing device of claim 23, wherein said winnings the user receives are from a jackpot.

25. The computing device of claim 1, wherein the computing device is a mobile device operable by a user, wherein the application program serves as an app for the mobile device and thus may be downloadable from an online store to the mobile device and immediately installed for operation on the mobile device;

wherein said operating the computing device is to capture, for identity authentication, at least said image of a fingerprint of the user; and wherein the identity authentication session is commenced, if the user has not yet been identity authenticated, as an initial identity authentication session preceded by launch of the application program.

26. A method of advising a user of a lottery pick advising service, said method comprising for a computing device that includes a screen and a front-facing camera:

offering the user a full-price upfront option of paying in full upfront, wherein the payment is in exchange for the user receiving from a lottery pick advising service a suggestion on one or more picks to play in a particular upcoming lottery drawing;

offering the user an alternative option of at least one of at a reduced price upfront and free-of-charge upfront receiving by the user a suggestion from the lottery pick advising service on one or more picks to play in said particular upcoming lottery drawing, wherein the alternative option involves making, prior to said receiving under the alternative option, a contingency fee arrangement such that the user is, by accepting the alternative option, conditionally committing, dependent on an outcome of said particular upcoming lottery drawing, to, after said particular upcoming lottery drawing, provide, if there are winnings that are from said particular upcoming lottery drawing and from said suggestion, the lottery pick advising service in compensation, as a contingency fee, for said suggestion with a portion, that is less than all, of winnings the user receives from said particular lottery drawing from laying from said suggestion; and, as part of an identity authentication session of the application program operating the computing device to, during the identity authentication session, capture, for identity authentication; an image of a fingerprint of the user, an image of the user's face with the front-facing camera such that the user's face is facing the screen, or both types of images;

wherein the operating to capture the image of the fingerprint, if the capturing of such is configured in the processor-executable code, operates any one or more of the front facing camera, another camera, and a fingerprint scanner.

27. The method of claim 26, wherein the alternative option involves said receiving the suggestion free-of-charge upfront; and wherein the offering of the full-price upfront option and the alterative option entails displaying the full-price upfront option and the alternative option simultaneously.

28. A non-transitory computer readable medium embodying an application program for operating a computing device, that includes the medium, a screen, and a camera, for lottery pick advising, said program having instructions executable by a processor for performing a plurality of acts, from among said plurality there being the acts of:

offering the user a full-price upfront option of paying in full upfront, wherein the payment is in exchange for the user receiving from a lottery pick advising service a suggestion on one or more picks to play in a particular upcoming lottery drawing;

offering the user an alternative option of at least one of at a reduced price upfront and free-of-charge upfront receiving by the user a suggestion from the lotter pick advising services on one or more picks to play in said particular upcoming lottery drawing, wherein the alternative option involves making, prior to said receiving under the alternative option, a contingency fee arrangement such that the user is, by accepting the alternative option, conditionally committing, dependent on an outcome of said particular upcoming lottery drawing, to, after said articular upcoming lottery drawing, provide, if there are winnings that are from said articular upcoming lottery drawing and from said suggestion, the lottery pick advising service in compensation, as a contingency fee, for said suggestion with a portion, that is less than all, of winnings the user receives from said particular lottery drawing from playing from said suggestion; and, as part of an identity authentication session of the application program, operating the computing device to, during the identity authentication session, capture, for identity authentication, an image of a fingerprint of the user, an image of the user's face with the camera such that the user's face is facing the screen, or both types of images;

wherein the operating to capture the image of the fingerprint, if the capturing of such is configured in the processor-executable code, operates any one or more of the camera, another camera, and a fingerprint scanner.

* * * * *